US008881461B2

(12) United States Patent
Derham

(10) Patent No.: US 8,881,461 B2
(45) Date of Patent: Nov. 11, 2014

(54) SASH WINDOW RESTRICTOR

(75) Inventor: Michael Derham, Cambridge (GB)

(73) Assignee: Mighton Products Limited, Essex (GB)

( * ) Notice: Subject to any disclaimer, the term of this patent is extended or adjusted under 35 U.S.C. 154(b) by 469 days.

(21) Appl. No.: 12/999,751

(22) PCT Filed: Jun. 19, 2009

(86) PCT No.: PCT/GB2009/001526

§ 371 (c)(1),
(2), (4) Date: Dec. 17, 2010

(87) PCT Pub. No.: WO2009/153562

PCT Pub. Date: Dec. 23, 2009

(65) Prior Publication Data

US 2011/0113695 A1 May 19, 2011

(30) Foreign Application Priority Data

Jun. 19, 2008 (GB) ..... 0811324.3
Sep. 18, 2008 (GB) ..... 0817136.5
Sep. 18, 2008 (GB) ..... 0817137.3

(51) Int. Cl.
*E05B 55/00* (2006.01)

(52) U.S. Cl.
USPC ..... 49/449; 292/338

(58) Field of Classification Search
USPC ..... 49/449; 292/121, 128, 101, 102, 103, 292/108, 194, 219, 228, 202, 203, 204, 210, 292/251.5, 297, 298, 304, 338, DIG. 20, 292/DIG. 47
See application file for complete search history.

(56) References Cited

U.S. PATENT DOCUMENTS

| | | | | |
|---|---|---|---|---|
| 417,868 | A | 12/1889 | Janes | |
| 756,453 | A | 4/1904 | Arens et al. | |
| 785,367 | A * | 3/1905 | Mason | 292/127 |
| 833,900 | A | 10/1906 | Sigler | |
| 881,658 | A | 3/1908 | Bowman | |
| 976,777 | A | 11/1910 | Brown | |
| 1,601,051 | A | 9/1926 | Wilbert | |
| 1,724,637 | A | 8/1929 | Bergstrom | |
| 4,824,154 | A | 4/1989 | Simpson | |
| 4,917,416 | A | 4/1990 | Westphal et al. | |
| 4,919,464 | A * | 4/1990 | Richards | 292/251.5 |

(Continued)

FOREIGN PATENT DOCUMENTS

| | | |
|---|---|---|
| GB | 2 410 058 | 7/2005 |
| JP | 5171848 | 7/1993 |

(Continued)

*Primary Examiner* — Jerry Redman
(74) *Attorney, Agent, or Firm* — Burr & Brown, PLLC

(57) ABSTRACT

A sash window restrictor (20) has a housing (22) which is to be let into a vertical frame member (10) of one sash (normally the upper, outer sash) of a window, at a position, say, 10 cm above the top rail of the lower sash when the windows are closed. A tab (24) is mounted in the housing and can be retracted into the housing or extended from the housing. A mechanism acts between the tab and the housing and allows the tab to be pressed into the housing and held in the housing for a period of time before the tab is released to allow the tab to extend. With the tab extended, the lower sash (12) can be lifted until it reaches the tab (24) but no further, so that a 10 cm gap will be opened at the bottom of the window.

50 Claims, 23 Drawing Sheets

(56) References Cited

U.S. PATENT DOCUMENTS

| | | | | |
|---|---|---|---|---|
| 5,188,405 | A * | 2/1993 | Maccaferri | 292/204 |
| 5,248,174 | A | 9/1993 | Matz et al. | |
| 5,307,655 | A | 5/1994 | Boltz et al. | |
| 5,536,052 | A | 7/1996 | Maier | |
| 5,553,903 | A | 9/1996 | Prete et al. | |
| 5,575,116 | A | 11/1996 | Carlson et al. | |
| 5,806,900 | A | 9/1998 | Bratcher et al. | |
| 6,000,735 | A | 12/1999 | Jourdenais | |
| 6,021,603 | A | 2/2000 | Prete et al. | |
| 6,575,503 | B1 | 6/2003 | Johansson et al. | |
| 6,848,728 | B2 | 2/2005 | Rotondi et al. | |
| 7,147,255 | B2 * | 12/2006 | Goldenberg et al. | 292/241 |
| 7,188,871 | B2 | 3/2007 | Nemoto et al. | |
| 7,396,054 | B2 | 7/2008 | Carrier | |
| 7,407,199 | B2 | 8/2008 | Richardson | |
| 7,431,356 | B2 | 10/2008 | Liang et al. | |
| 7,441,811 | B2 | 10/2008 | Lawrence | |
| 7,452,014 | B2 | 11/2008 | Vetter | |
| 7,494,164 | B1 | 2/2009 | Garries et al. | |
| 7,530,611 | B2 | 5/2009 | Liang et al. | |
| 7,588,271 | B1 | 9/2009 | Lawrence | |
| 7,591,494 | B2 | 9/2009 | Mitchell | |
| 7,600,796 | B2 | 10/2009 | Liang et al. | |
| 7,637,544 | B2 | 12/2009 | Liang et al. | |
| 2005/0156433 | A1 | 7/2005 | Nemoto et al. | |
| 2006/0033345 | A1 | 2/2006 | Richardson | |
| 2007/0194578 | A1 | 8/2007 | Boosey et al. | |
| 2007/0209285 | A1 | 9/2007 | Bestler et al. | |
| 2007/0222233 | A1 | 9/2007 | Liang et al. | |
| 2007/0222234 | A1 | 9/2007 | Liang et al. | |
| 2008/0079268 | A1 | 4/2008 | Liang et al. | |
| 2008/0127568 | A1 | 6/2008 | Liang et al. | |
| 2009/0206616 | A1 | 8/2009 | Liang et al. | |

FOREIGN PATENT DOCUMENTS

| | | |
|---|---|---|
| WO | 91/18168 | 11/1991 |
| WO | 99/46464 | 9/1999 |
| WO | 2004/038141 | 5/2004 |
| WO | 2005/078218 | 8/2005 |
| WO | 2009/072839 | 6/2009 |

* cited by examiner 720
722
724
710
714
712
750
718
716
780
788
782

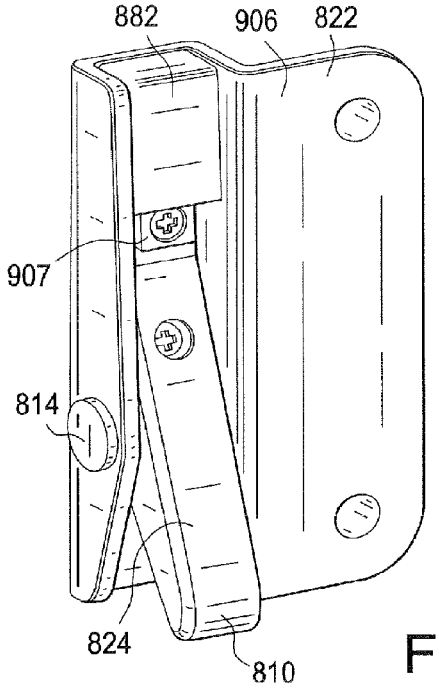
FIG. 39
FIG. 40
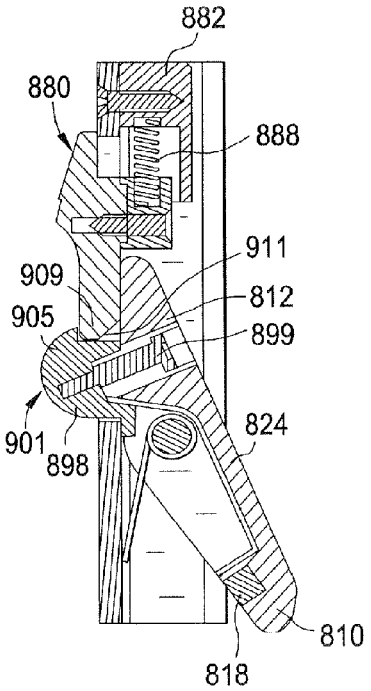
FIG. 41
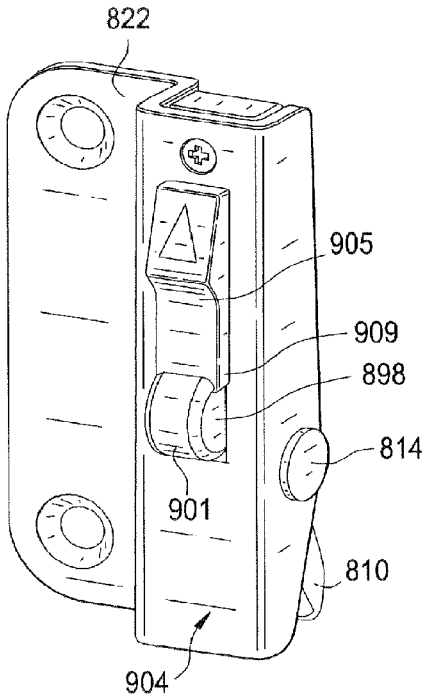

SASH WINDOW RESTRICTOR

FIELD OF THE INVENTION

This invention relates to a device for limiting or restricting the extent of opening of a sliding sash window. This device will be referred to herein as a sash window restrictor.

There is a requirement to restrict the extent to which a sash window can be opened, partly to prevent children opening a window beyond a certain distance so that they cannot fall out through the window, and partly from an anti-theft point of view, to prevent the window being opened from the outside.

However any such restrictor needs to be capable of being overridden when the window is to be fully opened by an adult, from the inside.

It is an aim of the present invention to overcome at least one problem associated with the prior art whether referred to herein or otherwise.

SUMMARY OF THE INVENTION

According to a first aspect of the present invention, there is provided a sash restrictor comprising a housing, a tab which is retractable into the housing and extendable from the housing, and a mechanism acting between the tab and the housing which allows the tab to be pressed into the housing and which holds the tab in the housing, the mechanism comprising latching means to latch the tab in a retracted position.

Preferably the latching means requires an actuation in order to release the tab and to allow the tab to extend from the housing.

The latching means may comprise magnetic means. Preferably the tab comprises a first magnetic member and the housing comprises a second magnetic member and wherein, in the latched condition, the first magnetic member engages with the second magnetic member.

In order to change from a latched condition to an unlatched condition, preferably the first magnetic member is relatively moved to a position sufficiently spaced from the second magnetic member. Preferably the first magnetic member is arranged, in use, to be moved relative to the second magnetic member manually by a user.

The mechanism may comprise urging means to urge first magnetic member away from the second magnetic member.

The mechanism may comprise urging means to urge the tab from the retracted position to the extended position. Preferably the urging means resists movement of the tab from the extended position to the retracted position.

The urging means may comprise resilient means.

The urging means may comprise a spring and preferably comprises a torsion spring.

Preferably the tab is pivotally mounted to the housing.

Preferably the tab comprises a first arm and a second arm. The first arm may comprise a latching member and the second arm may comprise an actuation member in order to unlatch the tab from a retracted position. The first arm may comprise an actuation member in order to latch the tab in a retracted position.

Preferably, in use, a user manually moves the tab to a latched position to enable a sash to move relatively over the housing and the tab may then be unlatched either manually by the user or by the action of the sash in order to enable urging means to move the tab from the retracted position towards an extended position.

Preferably the tab is movable to a first position in which the tab is at least partially (and more preferably totally) retracted into the housing and the tab may not project beyond the housing. Preferably the housing is movable to a second position in which at least a part of the tab projects outwardly relative to the housing.

Preferably, in use, the tab is arranged to be manually moved from the second position to the first position and preferably for the tab to be latched in the first position.

Preferably, in use, the tab is arranged to automatically move by movement means from the first position to the second position and preferably once the tab has been unlatched by an actuation.

Preferably, in use, the tab is arranged to automatically move by movement means from a first retracted position to a second extended position once the tab has been unlatched by an actuation.

The actuation may comprise a manual actuation and may comprise a push movement by a user.

The actuation may comprise a contact force generated by movement of the sash window relative to the sash window restrictor.

The tab may be retained in the housing by magnetic means.

The housing will preferably be set into a vertical frame member of one sash (normally the upper, outer sash) of a window, at a position, say, 10 cm above the top rail of the lower sash when the windows are closed. When the tab is retracted, the tab may lie substantially flush with the frame member, but when extended will project from the frame member sufficiently far to prevent the lower sash from passing. With the tab extended, the lower sash can be lifted until it reaches the tab but no further, so that a 10 cm gap will be opened at the bottom of the window.

When the window is to be opened fully, the tab will be pressed in and the bottom sash will be slid up, past the retracted tab, before the tab is able to extend.

There may be restrictor devices on both sides of the window, or just on one side. If there are restrictor devices on both sides, two separate operations will be required before the window can open, and this can provide an added security measure to make it more difficult for a window to be opened by a child.

Where there is a restrictor device on only one side, the device may have a second user-actuated feature so that the tab can only be pressed in once the second feature has been actuated. Again, this can provide an added security measure to make it more difficult for a window to be opened by a child.

Many different mechanisms can be used to hold the tab in the housing for a period of time. Generally the tab will be extended from the housing by a spring, and when pressed back in, i.e. retracted into the housing, the spring will be tensioned. It may however be possible to design a mechanism where gravity, or another method, is used to extend the tab from the housing The tab may be pivoted in the housing such that one end of the tab will project from the housing, in the extended position. Alternatively, the tab may move linearly into and out of the housing. Part of the edge of the tab which, in use, will be facing the lower sash may have an inclined face to allow the sash to pass the tab, pushing it in to the housing as it does so, to allow the sash to pass even if the tab is not completely retracted. However such inclined face should only be at the outermost part of the tab edge, as the main part of that tab edge should be substantially at right angles to the direction of movement of the lower sash, so as to prevent the sash passing when the tab is fully extended.

The mechanism between the tab and the housing preferably incorporates a spring and energy is stored in the spring when the tab is pushed into the housing. The mechanism may lock the tab in the retracted position, and a trigger may be activated by the passing of the lowers sash to release the lock and to allow the tab to be extended by the spring. While the lower sash lies in front of the device, the tab can only extend into contact with the lower sash frame, but one the lower sash is returned to its closed position, the tab will spring fully out to prevent reopening of the window without the tab being pushed in again.

In another embodiment, the tab can be linearly movable and can be controlled by a push-push mechanism where the first push locks the tab in its retracted position in the housing and a subsequent push releases the tab, allowing it to extend. The second push can be provided by the lower sash as it passes the device.

In one form, the mechanism will not lock the tab in its retracted position, but will damp the restoring force of the spring, so that the spring is only able to slowly extend the tab. However in other embodiments, the tab may lock into the housing and a separate trigger can be operated, for example by movement of the lower sash, to release the tab.

Instead of a lock, the stored spring force may be released only slowly, for example under the control of some form of damping system. In this embodiment, the tab will start to extend as soon as the force pushing it into the retracted position is released. However the speed at which the tab extends will be slow enough to allow the lower sash to be moved past the device before very much extension has taken place.

According to a second aspect of the present invention, there is provided an assembly comprising a sash and a sash restrictor, the sash restrictor comprising a housing, a tab which is retractable into the housing and extendable from the housing, and a mechanism acting between the tab and the housing which allows the tab to be pressed into the housing and which holds the tab in the housing, the mechanism comprising latching means to latch the tab in a retracted position.

Preferably the sash restrictor prevents or at least inhibits movement of the sash relative to the sash restrictor whilst the tab is in the extended position.

Preferably the sash restrictor enables movement of the sash passed the sash restrictor whilst the tab is initially in a retracted position.

According to a third aspect of the present invention, there is provided a kit for assembly into a sash restrictor, the kit comprising a housing, a tab which is retractable, in use, into the housing and extendable from the housing, and a mechanism acting, in use, between the tab and the housing which allows the tab to be pressed into the housing and which holds the tab in the housing, the mechanism comprising latching means to latch the tab in a retracted position.

According to a fourth aspect of the present invention, there is provided a method of restricting movement of a sash comprising mounting a sash restrictor adjacent to a sash wherein the sash restrictor comprises a housing, a tab which is retractable into the housing and extendable from the housing, and a mechanism acting between the tab and the housing which allows the tab to be pressed into the housing and which holds the tab in the housing, the mechanism comprising latching means to latch the tab in a retracted position.

The method may comprise pushing the tab into the housing to latch the tab in a retracted position.

The method may comprise pushing an actuating member to release the latching means.

BRIEF DESCRIPTION OF THE DRAWINGS

The invention will now be further described, by way of example, with reference to the accompanying drawings, in which:

FIG. 39 is a rear perspective view of the sash window restrictor of FIG. 38;

FIG. 40 is a cross-sectional view of the sash window restrictor of FIG. 38;

FIG. 41 is a front perspective view of the sash window restrictor of FIG. 38;

DESCRIPTION OF THE PREFERRED EMBODIMENTS

Figure 1:
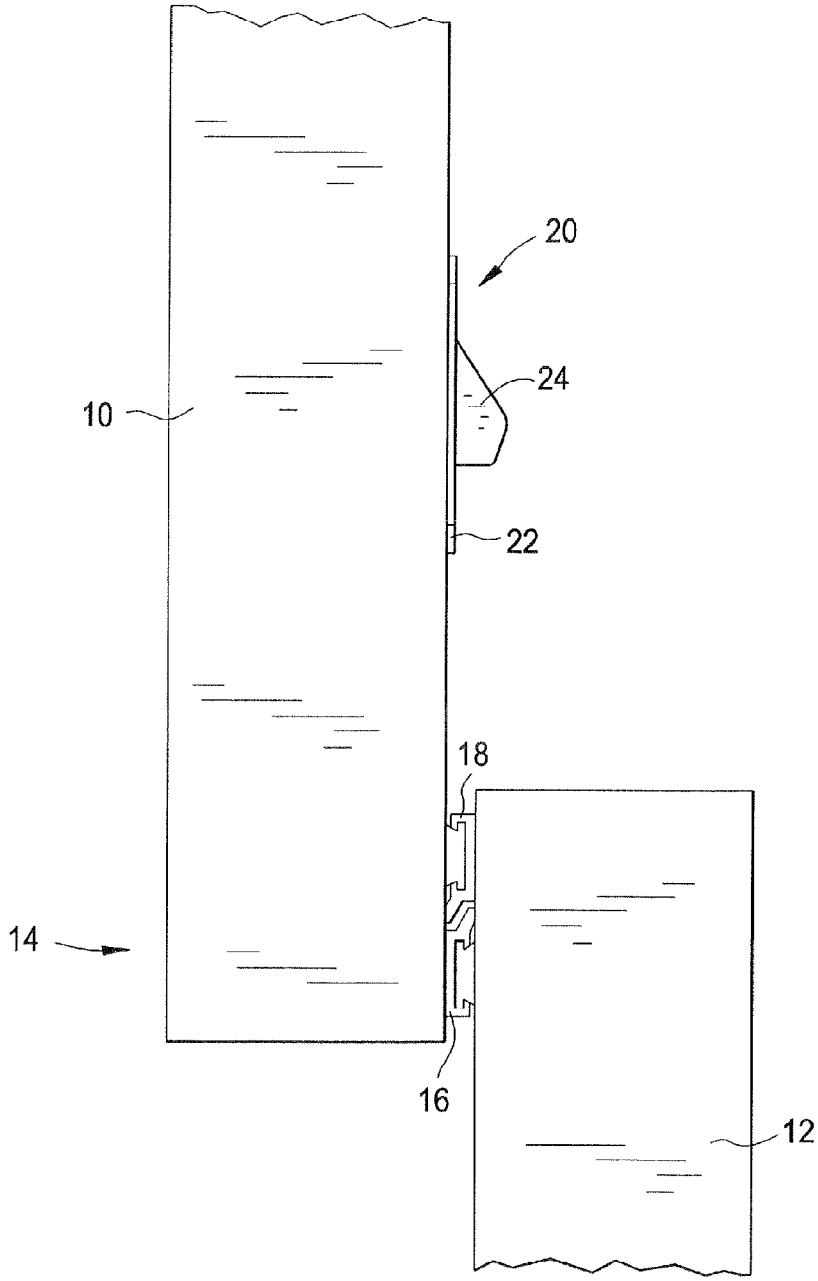
FIG. 1 is a side view through part of an upper and a lower sash, with a sash limiter device in accordance with the invention fitted in the upper sash.

FIG. 1 shows, in side view, an upper sash 10 and a lower sash 12. The sashes are shown in the position which they would take up when the window is closed, and in this position, the horizontal meeting rails of the two sashes overlap at 14. Weather seals 16, 18 are shown on the respective sashes to provide a seal when the window is closed.

The upper sash includes a sash limiter device at 20. This device has a housing 22 which is recessed into the sash frame 10, and a tab 24 which is movable between an extended, projecting position as shown, and a retracted position where it is housed substantially completely in the housing 22.

In the extended position of the tab 24 as shown in FIG. 1, the lower sash 12 can be raised relative to the upper sash 10, until the upper face of the lower sash comes into contact with the tab 24. Further lifting of the lower sash 12 is then prevented. However when it is desired to open the window completely, and to raise the lower sash 12 past the limiter device 20, the tab 24 can be pressed back and retracted into the housing 22 to allow the lower sash to pass the device.

It is desirable that the retracted tab should automatically extend itself out of the housing 20, once the leading edge of the lower sash 12 has moved passed. Thus, once the leading edge of the lower sash 12 has passed the device, the tab will extend, either gradually or quickly, and as the lower sash is lifted further, the tab will bear against a surface of the lower sash frame. In this way, once the lower sash is lowered again and the window is closed, the tab will automatically move to its extended position without any user intervention being required.

The tab will preferably be spring-loaded and can be pressed into the housing against spring pressure, with the spring being released to re-extend the tab once the lower sash has passed the device. In some embodiments, a secondary lock may lock the tab in the open position, and require release before the tab can be pressed in. It may be necessary to hold a button or the like release mechanism whilst at the same time pressing in the tab.

Figure 2:
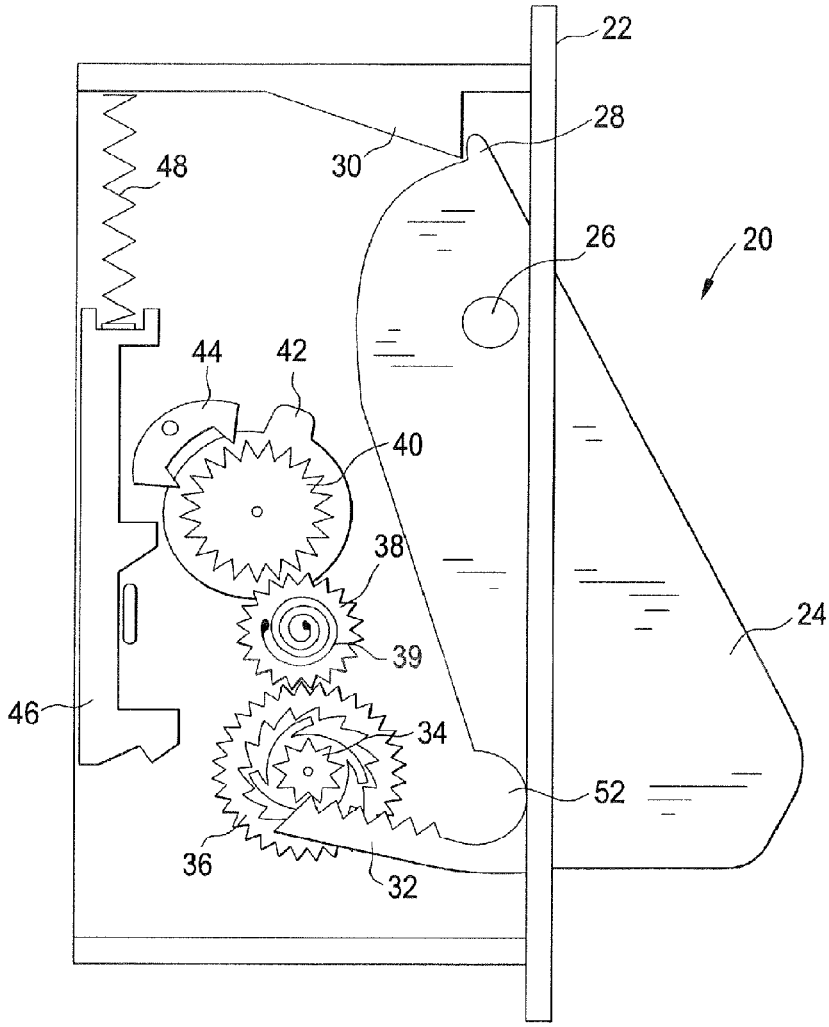
FIG. 2 is a schematic representation of the sash limiter device from FIG. 1, with the tab extended.
Figure 3:
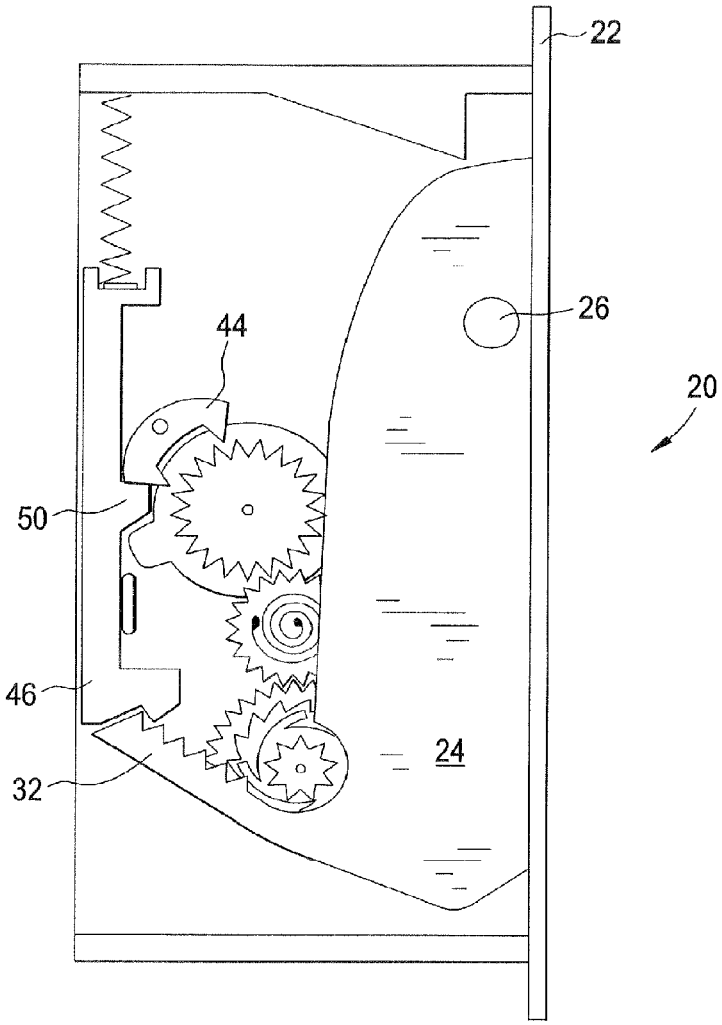
FIG. 3 corresponds to FIG. 2 but shows the tab retracted.

The tab itself may take up a number of different configurations. In FIGS. 1, 2 and 3 the tab is generally triangular and is pivoted at 26 in the housing. The tab may however slide in the housing between its extended and retracted positions. The tab has a tapered edge at 24*a*, so that the lower sash can pass over the tab, even though the tab might not be fully retracted.

FIG. 2 shows one example of a mechanism which can be used to control extension and retraction of the tab 24. The extension of the tab, into the position shown in FIG. 2, is limited by engagement between an ear 28 on the tab and a shoulder 30 in the housing.

When the tab is pushed in, a rack 32 which is integral with the tab engages with a first, inner sprocket 34 and rotates that sprocket in a clockwise direction. This rotation entrains an outer sprocket 36. The outer sprocket 36 engages with a second sprocket 38, and this second sprocket includes a coil spring 39 which is wound up as the tab is pushed in and the second sprocket rotates. A third sprocket 40 meshes with the sprocket 38 and has a release cam 42 at one point around its circumference, and an escapement 44. The housing also contains a retaining plate 46 which is vertically slidable in the housing under the influence of a spring 48.

As can be seen from FIG. 3, when the tab is fully retracted, the end of the rack 32 engages with a detent on the bottom of the plate 46, and in this position the tab 24 is held in the retracted position. However the stored energy in the spring 39 continues to drive the sprocket 40 and its associated cam 42 in a clockwise direction. The extent to which the rotation can take place is limited by the rocking movement of the escapement 44, but the cam 42 will contact a lug 50 on the plate 46, to release the tab which will then be driven into its extended position by the stored energy in the spring 39.

It will be noted that the first sprocket 34 has a clutch mechanism within the outer sprocket 36, and this ensures that rotation of the sprocket 34 in a clockwise direction rotates the outer sprocket 36, but when the inner sprocket rotates in the opposite direction, the sprocket 36 is not entrained. In the retracted position shown in FIG. 3, the inner sprocket 34 can rotate freely within a part circular cut-out 52 in the tab.

Figure 4:
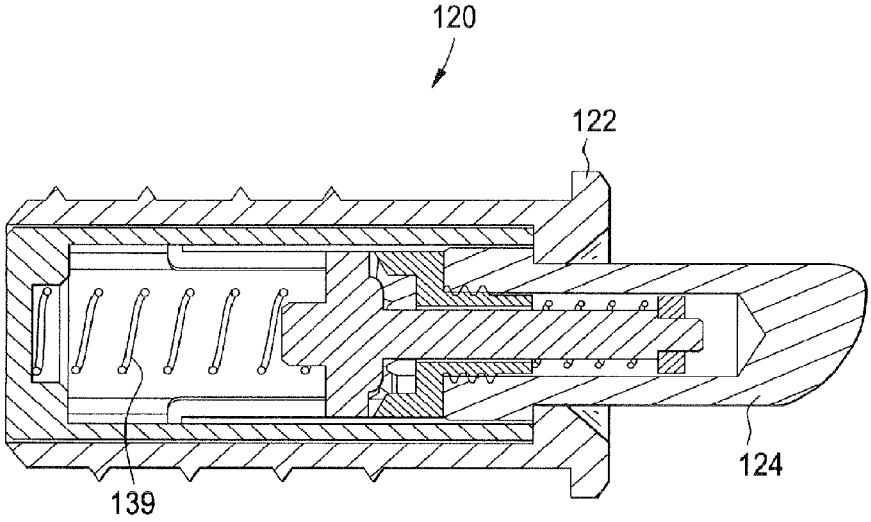
FIG. 4 is a cross-sectional view through a second type of sash limiter device in accordance with the invention.
Figure 5:
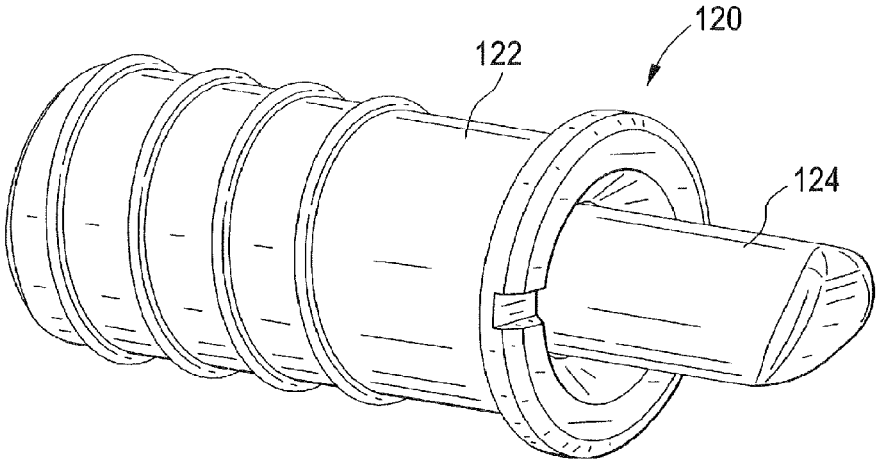
FIG. 5 is a perspective view of the device of FIG. 4.
Figure 6:
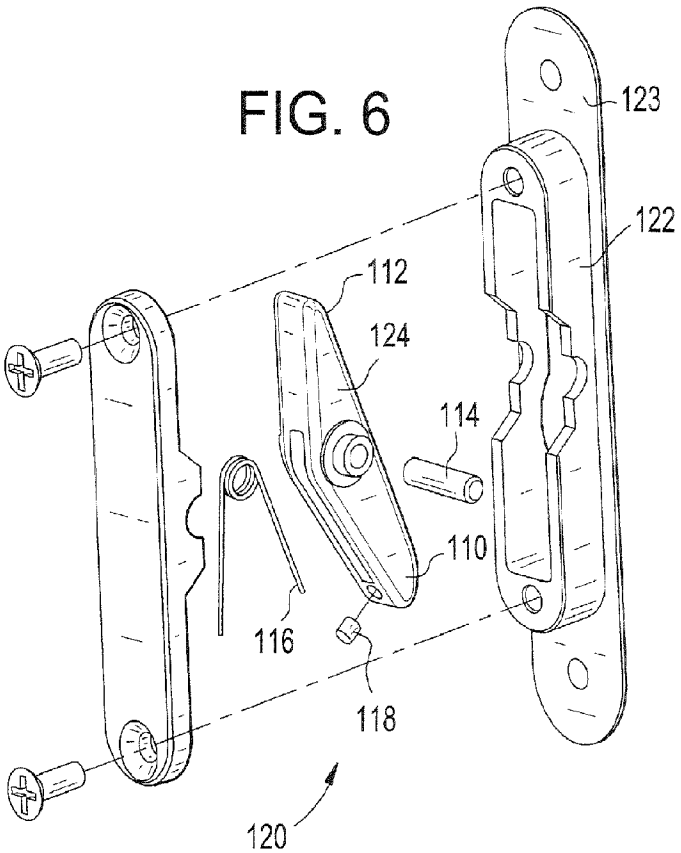
FIG. 6 is an exploded view of a preferred embodiment of a sash window restrictor.
Figure 9:
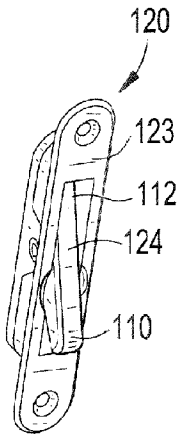
FIG. 9 is a perspective view of a preferred embodiment of a sash window restrictor.
Figure 8:
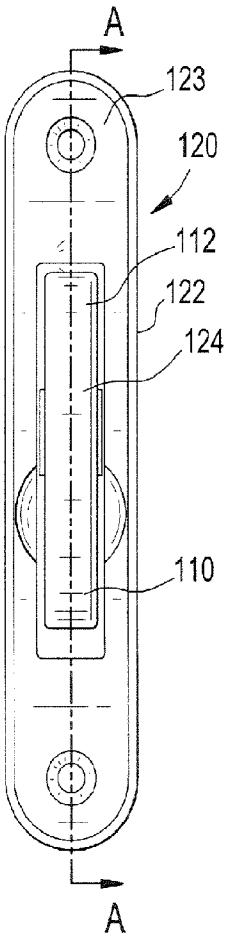
FIG. 8 is a front view of a preferred embodiment of a sash window restrictor.
Figure 7:
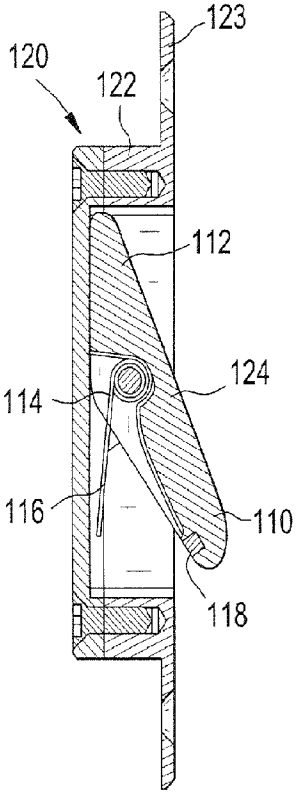
FIG. 7 is a side cross section of a preferred embodiment of a sash window restrictor.

FIGS. 4 and 5 show another embodiment where the tab 124 slides linearly into and out of a housing 122. The mechanism of this device works on a "push-push" principle, i.e. when the tab 124 is pushed in, it locks into a retracted position and if it is pushed again, the lock is released and a spring 139 extends the tab. In this case, the tab 124 has a tapered end, and the dimensions and stroke of the tab 124 will be such that, in the retracted position, the tip of the tab extends from the housing 122, with the tapered face facing the direction from which the lower sash will approach. When the lower sash contacts the tapered face, it will press the tab inwards to allow the window to pass, but also at the same time the lower sash will provide the second "push" to activate the release of the tab which will then be biased by the spring 139 against the face of the sash frame, as the sash moves past the tab. When the sash is moved back to its closed position, and passes the device 120, the tab 124 will be free to move to its fully extended position where it blocks movement of the sash past the tab.

To enable the window to be opened, the user must push the tab in so that it locks in the retracted position.

The devices described are just two examples of sash window restrictors. It is important that the restrictor, once retracted to allow the window to be fully opened, automatically resets itself so that when the window is closed, the tab of the restrictor automatically moves into its window restricting position.

The tab can be any shape which can prevent movement of one sash past the other, and the term "tab" is not intended to limit the possible forms of this component.

There may be sash restricting devices of this type on one side of a window, or on both sides of the window. If there are safety requirements requiring at least two manual operations before a window can be fully opened, these requirements can be met by fitting a device as described here on both sides of the window. Alternatively (or additionally) the or each device can be provided with a secondary lock which locks the tab in the extended position and requires manual operation to release that lock before the tab can be pushed in.

As shown in FIG. 6 to FIG. 9, a preferred embodiment of a sash window restrictor 120 comprises a tab 124 which is pivotally mounted in a housing 122. The tab provides a first arm 110 and a second arm 112 located on either side of the pivot member 114. A torsion spring 116 is provided which urges the first arm from a first retracted position to a second extended position. The first arm 110 also includes a magnet 118 which is arranged in use to engage with a part of the housing 122 which thereby comprises a magnetic material. The housing may comprise a magnetic material or may have a specific magnetic element mounted therein.

Figure 10:
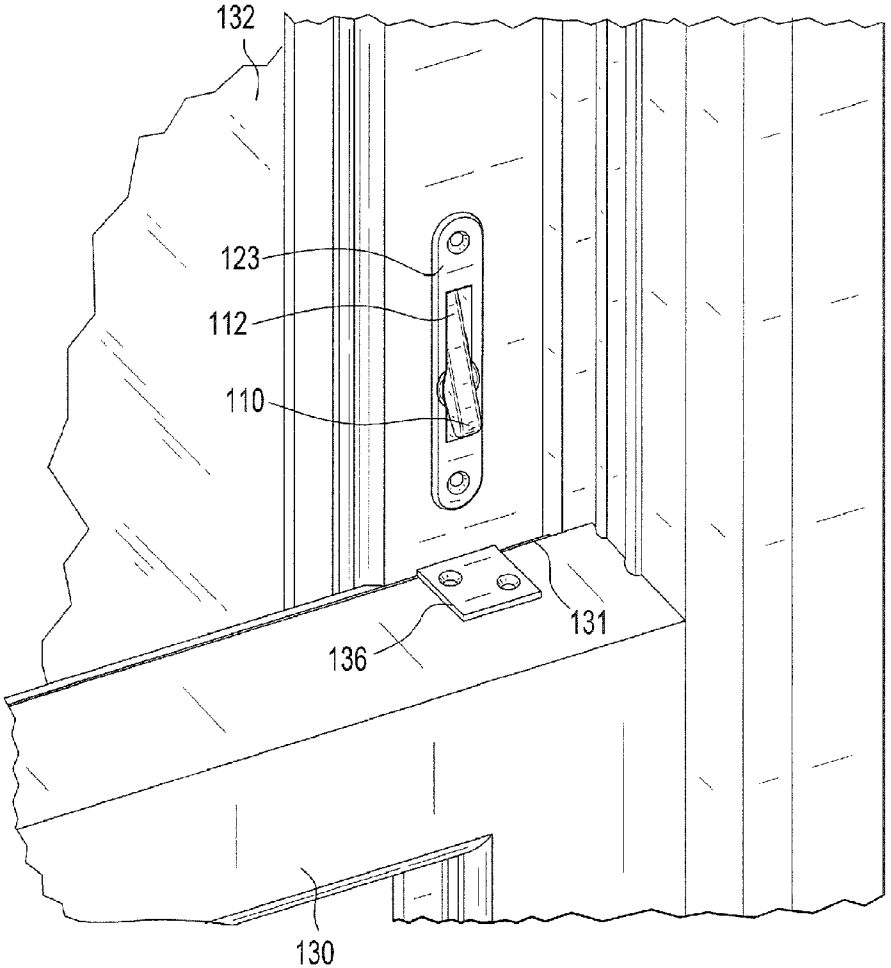
FIG. 10 is a perspective view of a preferred embodiment of a sash window restrictor mounted to a sash window assembly.
Figure 11:
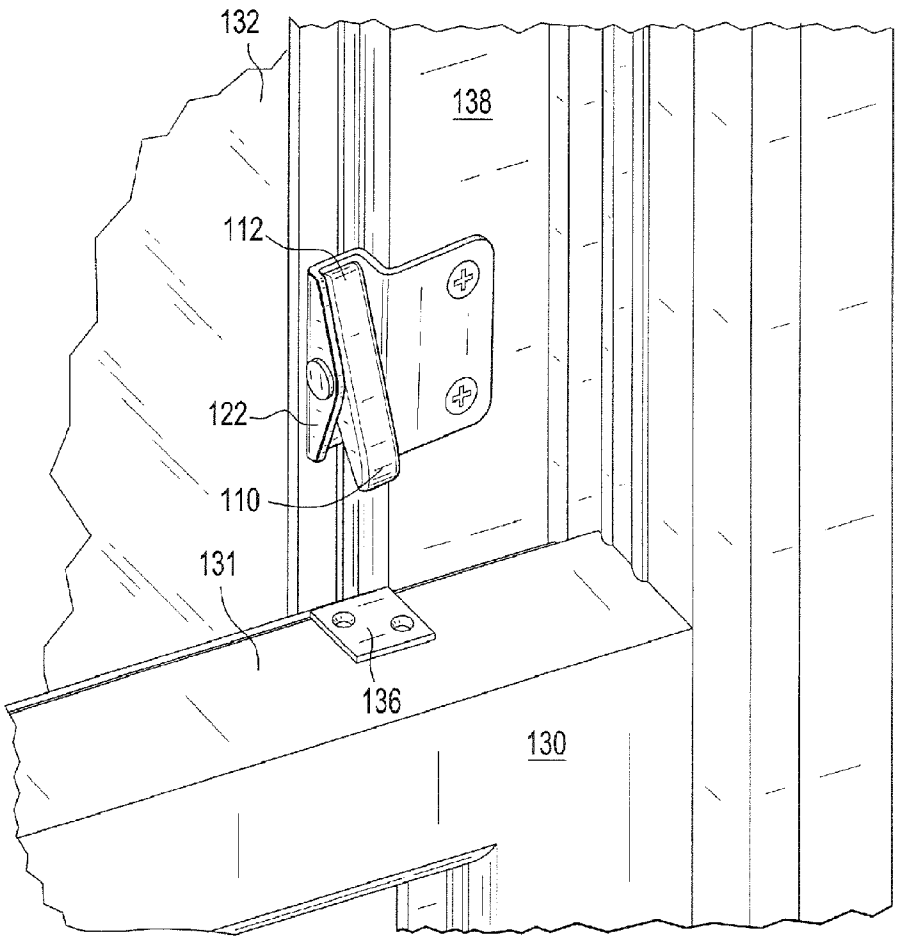
FIG. 11 is a perspective view of another embodiment of a sash window restrictor mounted to a sash window assembly.
Figure 12:
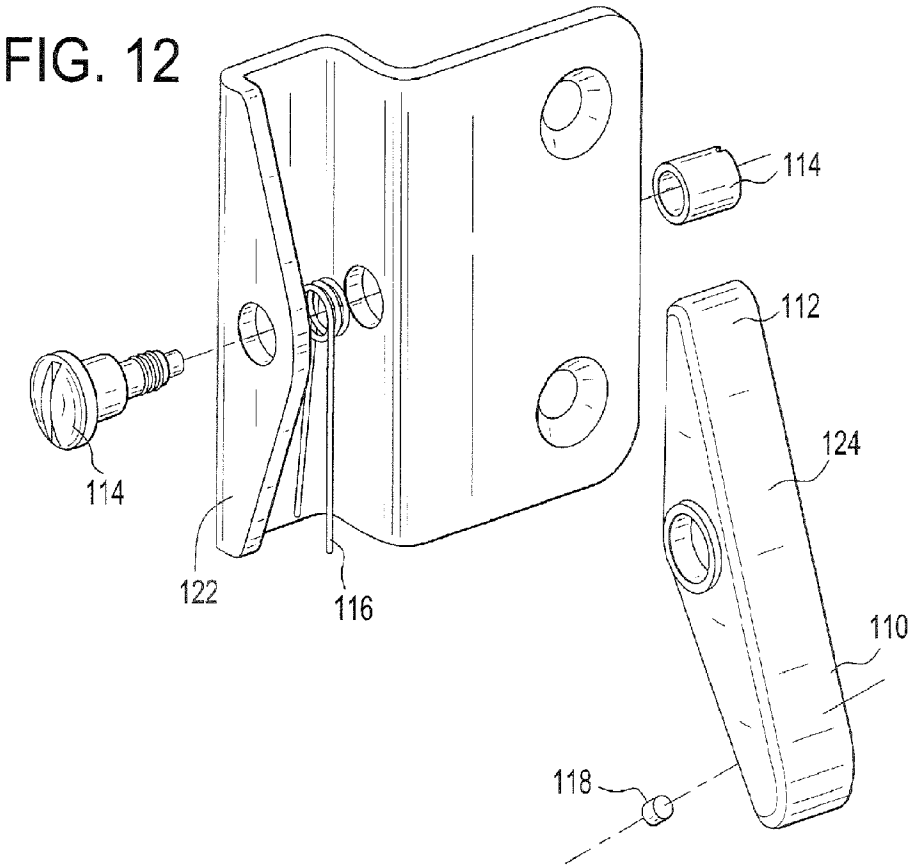
FIG. 12 is an exploded view of another embodiment of a sash window restrictor.
Figure 14:
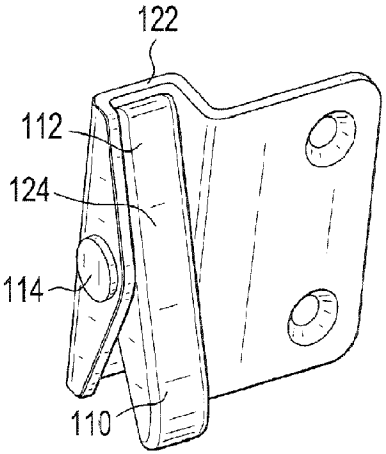
FIG. 14 is a front perspective view of another embodiment of a sash window restrictor.
Figure 15:
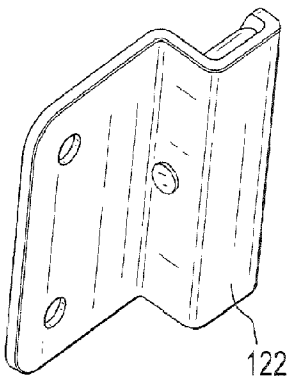
FIG. 15 is a rear perspective view of another embodiment of a sash window restrictor.

The sash window restrictor 120 is arranged in use to be mounted to a sash window assembly and is arranged to be mounted to a lower part (or lower frame member) of the upper sash and is mounted as an inset such that the housing plate 123 is substantially flush with the outer surface of the lower part (or frame member) of the upper sash, as shown in FIG. 10. In particular, the sash window restrictor is arranged to be inset into the surface of timber or UPVC sashes.

In use, a user pushes the first arm 110 inwardly into the housing 122 in order for the magnet 118 to engage with the magnetic material of the housing 122 and for the tab 124 to be held in a retracted position. The lower sash window 130 can then be moved upwardly relative to the upper sash window 132. When the tab 124 is held in the retracted position, the second arm 112 of the tab 124 projects outwardly from the housing 122 such that an upper part 131 (or upper frame member) will contact the second arm 112 in order to unlatch the magnet 118. The torsion spring 116 then urges the tab 124 to extend. Movement of the upper sash window 132 over the first arm 110 is insufficient to engage the magnet 118 with the housing 122. Accordingly, once the lower sash window 130 has returned to the lower closed position the tab 124 automatically extends to restrict upwards movement of the lower sash window 130 relative to the upper sash window 132. A reinforcement plate 136 is mounted on an upper part of the lower sash window 130 in order to provide a reinforced contact area which is arranged to contact the tab 124 to prevent or inhibit the lower sash window from being opened.

In another embodiment of the present invention as shown in FIG. 11 to FIG. 16, the sash window restrictor 120 is a surface mounted device which is arranged to be mounted to a side frame member 138 of an upper sash window 132.

The first arm 110 of the tab 124 normally projects out at an angle at the bottom of the sash window restrictor 120 and is held out by a torsion spring 116 which prevents the sash being raised beyond a chosen height. To allow the sash to be raised fully, the first arm 110 on the sash window restrictor 120 is pressed fully in until it is held in by magnetic contact. The second arm 112 of the tab 124 now projects so that when the sash is raised it pushes the second arm 112 inwards breaking contact with the magnet and allowing the spring 116 to push the first arm 110 up to the face of the sash. When the sash is lowered, as it passes the bottom of the first arm 110, the spring 116 pops the first arm 110 outwards and automatically resets it into the limiting position.

The version which sits at the side of the sash has the arm running along the surface of the glass rather than the surface of the sash frame.

In further embodiments of the present invention the latching mechanism may be provided by any suitable releasable latching means. For example, the latching means may comprise a plastic or metal snap feature to retain the first arm in the housing. Again the latching means is releasable by actuation as previously described.

Furthermore, the sash window restrictor may be lockable such that a lock mechanism protects and restricts the use and operation of the sash window restrictor.

There may also be locking versions of each type based on the same assemblies one using a key and another using a press button and further versions may use other suitable locking mechanisms. The press button version will automatically be set in the locked position and will have to have the button pressed to free the locking arm allowing it to be depressed and the sash to be opened. When the sash is closed the locking button will reset preventing the arm from being manually depressed. The key version will have to be manually unlocked with the key before the limiter can be used in the normal way and then locked with the key to make it secure.

The present invention is primarily applicable to sash windows and limiting or restricting the movement of a first sash window relative to a second sash window. However, the present invention can be used in other applications to prevent relative movement of a sash, for example the inset unit could be fitted into sliding patio doors to allow them to be opened a small distance while being secure.

In the descriptions of the embodiments that follow, like features have been have been indicated with numbers incremented by 100.

Figure 16:
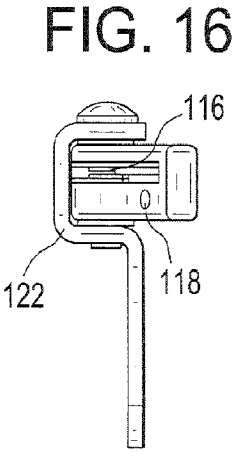
FIG. 16 is a bottom view of another embodiment of a sash window restrictor.
Figure 13:
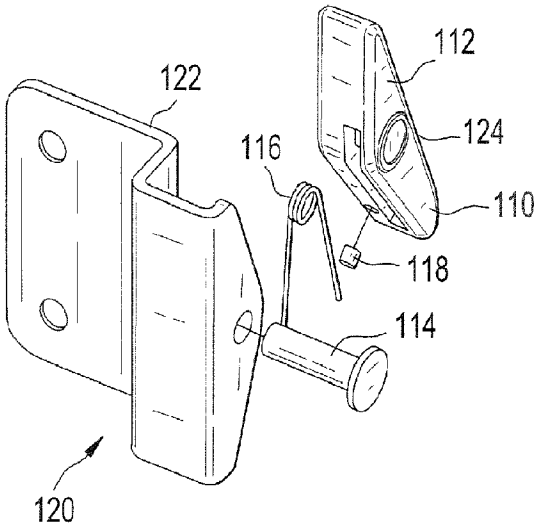
FIG. 13 is an exploded view of another embodiment of a sash window restrictor.
Figure 17:
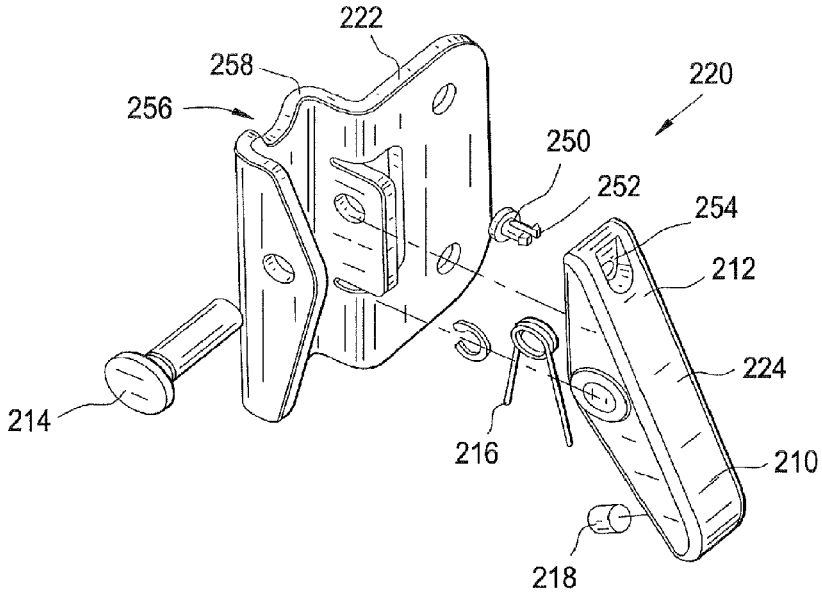
FIG. 17 is an exploded view of another embodiment of a sash window restrictor.
Figure 18:
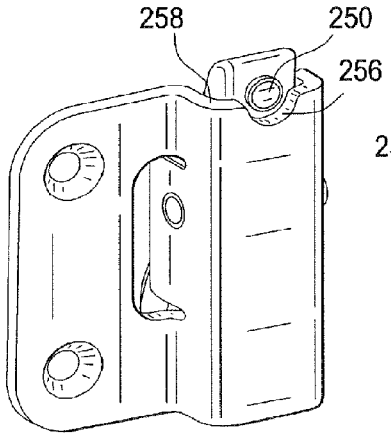
FIG. 18 is a front perspective view of the sash window restrictor of FIG. 17.
Figure 19:
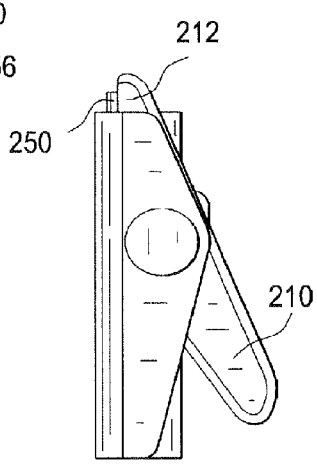
FIG. 19 is a side view of the sash window restrictor of FIG. 17.
Figure 20:
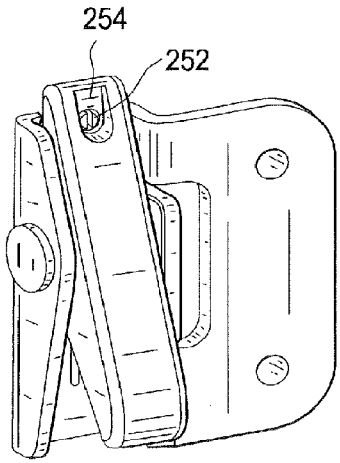
FIG. 20 is a rear perspective view of another embodiment of a sash window restrictor.
Figure 21:
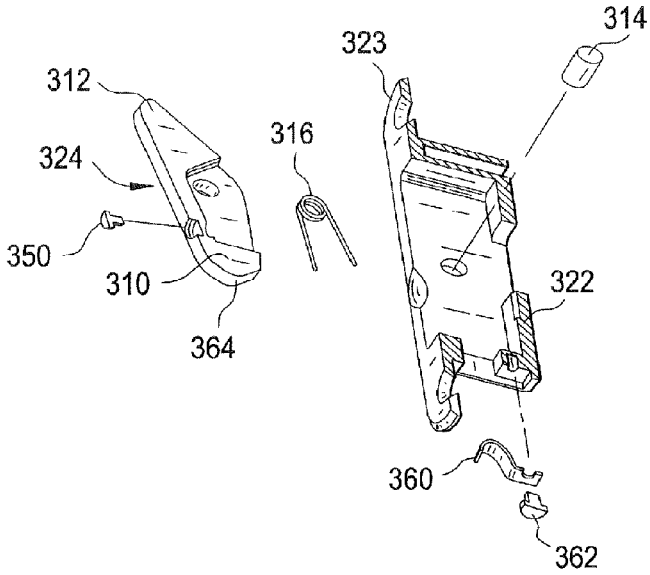
FIG. 21 is an exploded view of another embodiment of a sash window restrictor.
Figure 22:
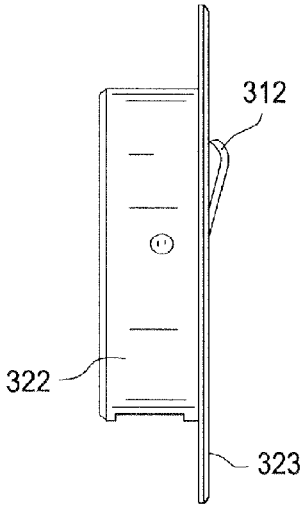
FIG. 22 is a side view of the sash window restrictor of FIG. 21.
Figure 23:
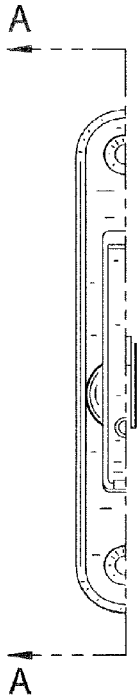
FIG. 23 is a sectioned front view of the sash window restrictor of FIG. 21.
Figure 24:
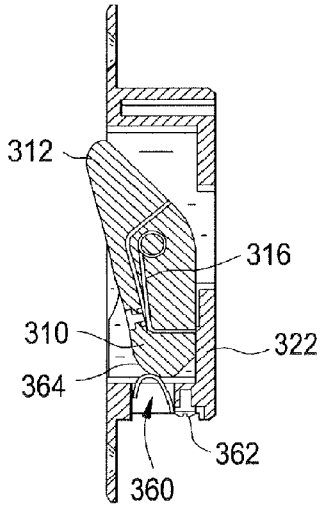
FIG. 24 is a section through the sash window restrictor of FIG. 23, along the line A-A.

FIGS. 17 to 20 show an embodiment of a sash window restrictor of the present invention that is similar to the embodiment shown in FIGS. 113 to 16. The sash window restrictor 220 of this embodiment includes an indicator 250 present in the second arm 212 of the tab 224. The indicator 250 may take the form of a red coloured disc that is visible from a front side of the restrictor 220. The indicator disc 250 is clearly visible by a user of the restrictor when the first arm 210 of the tab 224 is in an extended position thereby preventing upward movement of the sash. This is a safety feature to provide a warning that the window sash cannot be lifted without first retracting the first arm 210 of the tab 224, which may be achieved by pushing on or near the indicator disc 250 in the second arm 212. In this example, the indicator disc 250 comprises a retaining member 252 that sits in a recess 254 in the second arm 212. So that the whole of the indicator disc 250 is visible to a user of the device 220, a cut-out 256 is provided in a top edge 258 of the housing 222. In this case the cut-out 258 is semi-circular.

A further embodiment of the invention is shown in FIGS. 21 to 24. In this embodiment, the latching means 360 used to hold the first arm 310 in a retracted position takes the form of a spring 360 that engages with a lower edge 364 of the first arm 310 of the tab 324. In this example the spring is a leaf spring 360, but the latching means may be any other form of spring or resilient member. In one embodiment, the housing may be provided with a ball detent to retain the first arm 210 in a retracted position. The leaf spring 360 is held in position in the housing 322 by a small screw 362. The spring 360 may be held using any suitable means such that one end of the spring 360 is immovably fixed to the housing 322.

When the first arm 310 of the tab 324 is retracted and pushed inside the housing 322, the lower edge 364 of the first arm 310 rides over an upper end of the leaf spring 360. In this example, the upper end of the leaf spring 360 is curved to provide a smooth engagement surface with the end 364 of the first arm 310. In the retracted position, the first arm 310 is held within the housing 322 such that the end 364 of the first arm 310 is behind the leaf spring 360. When the second arm 312 is pressed, due to the movement of the window sash, the tab 324 pivots about the pivot member 314 and the first arm 310 is forced past the leaf spring 360 by the action of the torsion spring 316.

In this embodiment, an indicator 350 is provided in a front face of the first arm 310 of the tab 324. The indicator 350 has the same function as described hereinbefore.

Figure 25:
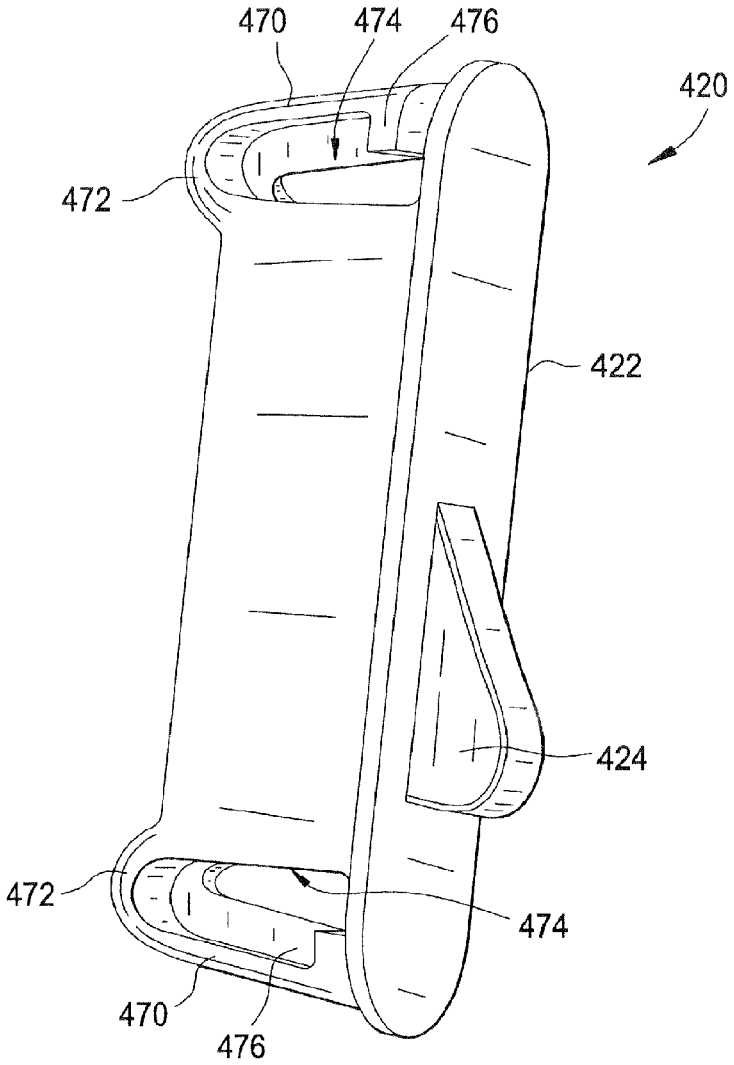
FIG. 25 is a perspective view of a push fit securement embodiment of a sash window restrictor.

FIG. 25 shows a push fit embodiment of the present invention. This embodiment enables the sash window restrictor 420 to be quickly and easily secured in a frame member and, in particular, in a hollow upvc window frame member. The housing 422 includes two retaining members, in this example retaining arms 470, one at each end 474 of the housing 422. The arms 470 are resilient members and are connected to the housing 422 by a first section 472 of the arm 470 in such a way that this section 472 of the arm 470 forms a hinge 472 and the arms 470 lie parallel with the ends 474 of the housing 422. In this way, when the restrictor 420 is pushed into the frame member, the arms 470 are pressed towards the housing 422 causing the hinges 472 to bend. The energy stored in the hinge sections 472 of the arms 470 urges the arms 470 outwards once the restrictor is placed in the frame member holding the restrictor within the frame. In particular, when the restrictor 420 is installed in a hollow upvc frame, the hole cut in the frame is such that as the restrictor 420 is pushed into the frame, the arms 470 are pressed in towards the housing 422. Once fully in the frame, the arms 470 are urged outwards by the action of the hinges 472 into the hollow of the frame thereby preventing the restrictor 420 from being pulled out. As shown in FIG. 25, the arms 470 may include a projection 476 at the second end of the arm 470. These projections 476 limit the distance the arms 470 can be pressed inwards which prevents the hinge 472 being bent too much.

Figure 26:
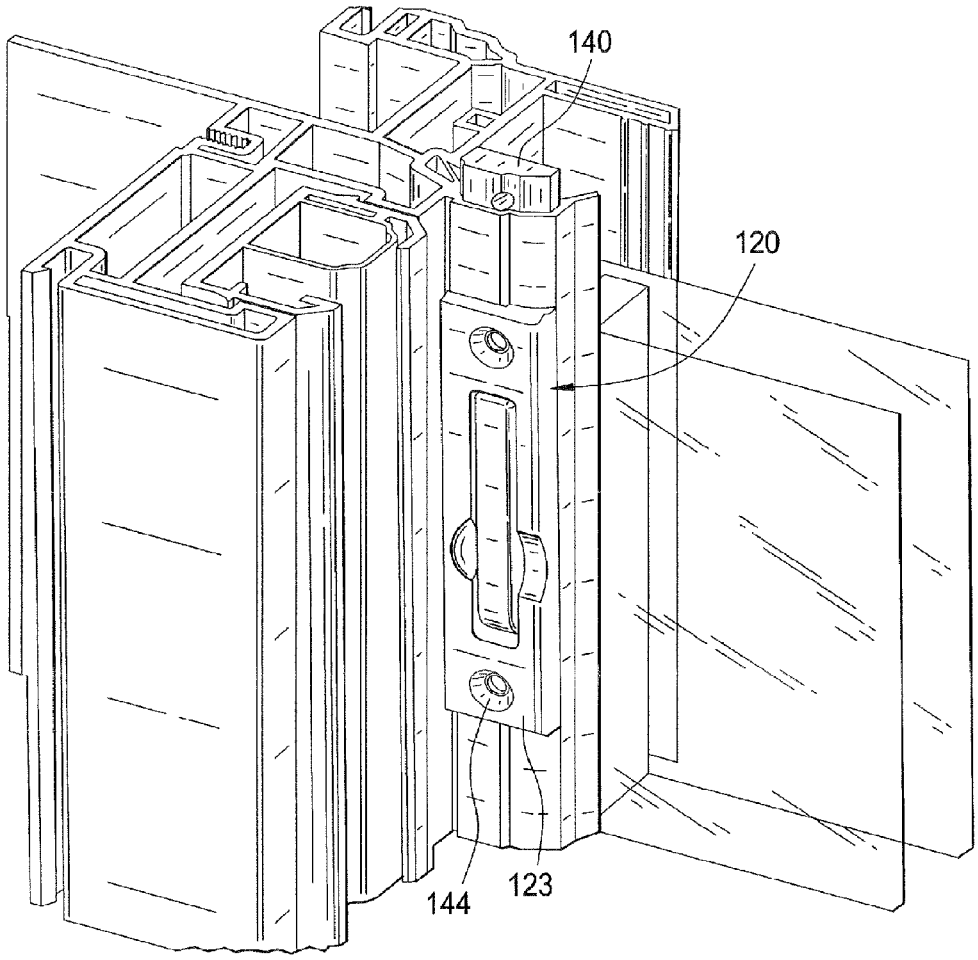
FIG. 26 is a perspective view of an insert for mounting a sash window restrictor.
Figure 27:
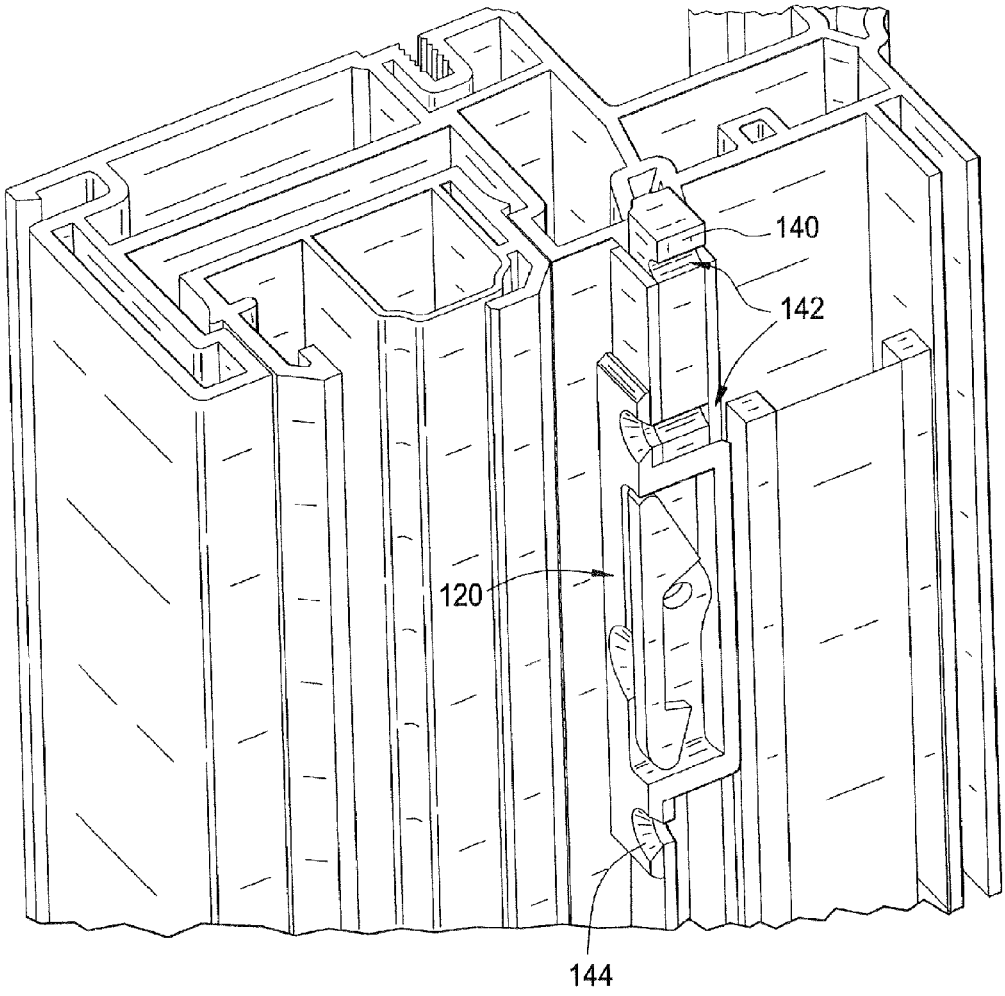
FIG. 27 is a sectional view of the insert of FIG. 26.
Figure 32:
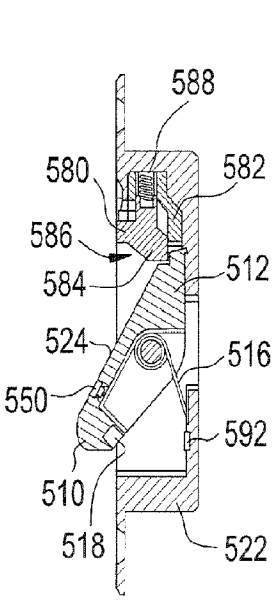
FIG. 32 is a sectional view of the sash window restrictor of FIG. 30 along the line B-B.
Figure 31:
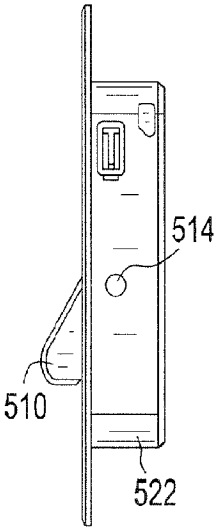
FIG. 31 is a side view of the sash window restrictor of FIG. 28.
Figure 30:
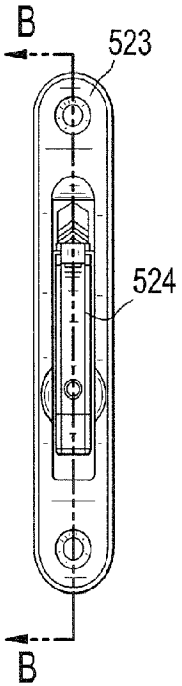
FIG. 30 is a front view of the sash window restrictor of FIG. 28.
Figure 29:
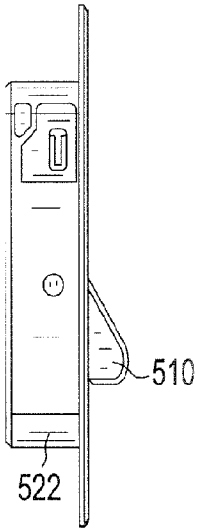
FIG. 29 is a side view of the sash window restrictor of FIG. 28.
Figure 28:
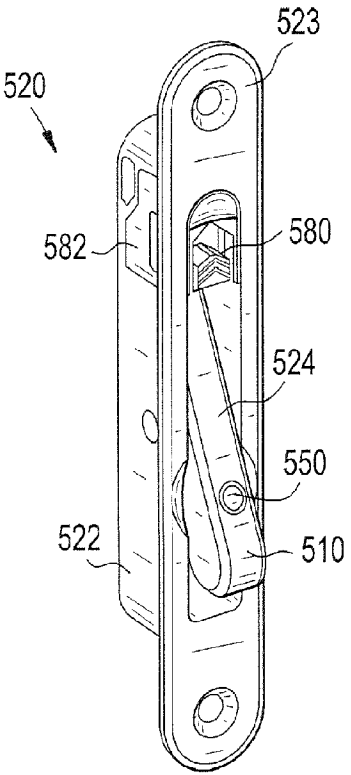
FIG. 28 is a perspective view of a front mounted sash window restrictor according to another embodiment of the invention.

In other embodiments, it may be required to fix a restrictor 120 to a hollow upvc frame using screws. In this case, it is necessary to provide an insert 140 that fits within the hollow space of the frame. As shown in FIGS. 26 and 27, this insert 140 takes the form of a bar or plate having through-thickness cylindrical holes 142. These cylindrical holes 142 align with the screw holes 144 present in the housing plate 123 and accommodate the shaft of the screw when the restrictor 120 is fixed in place. At least one face of the insert 140 may be shaped so that its profile is substantially the same as that of the upvc frame.

It will be appreciated that any of the embodiments of a sash window restrictor described so far may include locking means which locks the tab in the extended position. As described hereinbefore these locking means are designed such that a manual operation, for example the pressed or sliding of a button, is required to release that lock before the tab can be pushed in. Such locking means provide a dual action requirement for each single sash window restrictor.

As explained above, the operation of the sash window restrictor may comprise a single action although as mentioned above the opening of the window may require a double action or dual action restricting mechanism. In order to provide a dual action sash window restrictor means, the sash window may be provided with two separate single action sash window restrictors. Alternatively, the sash window restrictor is provided with a dual action requirement. For example, the sash window restrictor may be provided with a locking button that must be moved out of engagement with the tab to allow the tab to initially be pressed into the housing. In particular, the button is slid out of engagement with the tab to enable the tab to be pressed in which thereby provides a dual action requirement. The locking button is also arranged to automatically reset.

Further embodiments of a sash window restrictor will now be described that include locking means.

FIGS. 28 to 33 show an embodiment of the present invention that is similar to the embodiment shown in FIGS. 6 to 9. In this case, the restrictor 520 includes a slidable locking member 580. The locking member 580 slides within a lock housing 582 fixed into the housing 522 of the restrictor 520.

The locking member is arranged to engage with the second arm 512 of the tab 524. The locking member 580 is a substantially rectangular block having a locking foot 584 projecting at an angle from one end of the block. This locking foot 584 is designed to engage with a recess 586 in the second arm 512 of the tab 524 to hold the second arm 512 within the housing 522 and retain the first arm 510 in an extended position, as shown most clearly in FIG. 32.

At an opposite end of the locking member 580, biasing means, in this case a compression spring 588, is located between the locking member 580 and a part of the housing 522. In this example, the compression spring 588 extends through the lock housing 582, however, alternatively, the compression spring 588 may be located between the locking member 580 and a part of the lock housing 582. The compression spring 588 acts to bias the locking member 580 towards the tab 524, and in particular towards the second arm 512 of the tab 524.

In order to retract the first arm 510 of the tab 524 and push the first arm 510 within the housing 522, the locking member 580 must first be disengaged from the second arm 512.

In this way, when the first arm 510 of the tab 524 is projecting out from the housing 522 of the sash window restrictor 520 to prevent a window sash being raised beyond a chosen height, the locking foot 584 is engaged in the recess 586 in the second arm 512 of the tab 524 and is held in this position by the action of the compression spring 588. To allow the sash to be raised fully, the locking member 580 must first be slid in a direction away from the tab 580, in this example in an upwards direction into the lock housing 582. With the locking foot 584 removed from the recess 586, the first arm 510 on the sash window restrictor 520 can then be pressed fully in until it is held in by magnetic contact, as described hereinbefore. Once a user has released the locking member 580, the compression spring 588 urges the locking member 580 downwards so that the locking foot 584 extends behind the second arm 512 of the tab 524.

In this position, the second arm 512 of the tab 524 now projects outwards so that when the sash is raised it acts to push the second arm 512 inwards. A rear edge of the second arm 512 contacts a sloping face 590 of the locking member 580 and the locking member 580 slides upwards over the second arm 512. As the second arm 512 moves further inside the housing 522, the locking member 580 slides over the tip of the second arm 512 and the locking member 580 is then urged towards the second arm 512 and the locking foot 584 engages in the recess 586.

In addition, in this embodiment, the magnet 518 located in the first arm 510 engages with a second magnet 592 that is fixed to the housing 522. The two magnets 518, 592 are oriented so that opposite poles of the magnets 518, 592 make touching contact when the first arm 510 moves inside the housing 522.

Figure 34:
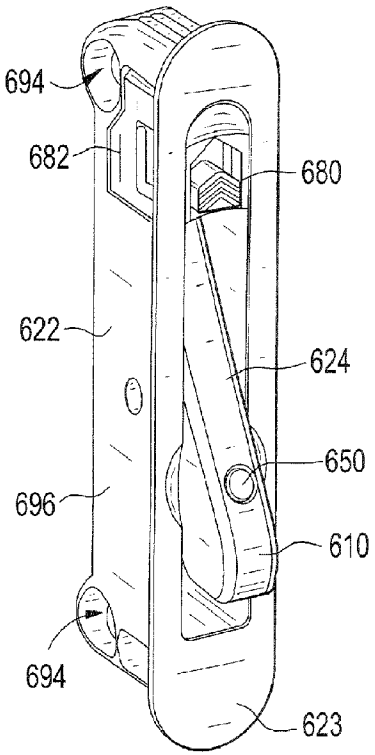
FIG. 34 is a front perspective view of a side mounted sash window restrictor according to another embodiment of the invention.
Figure 33:
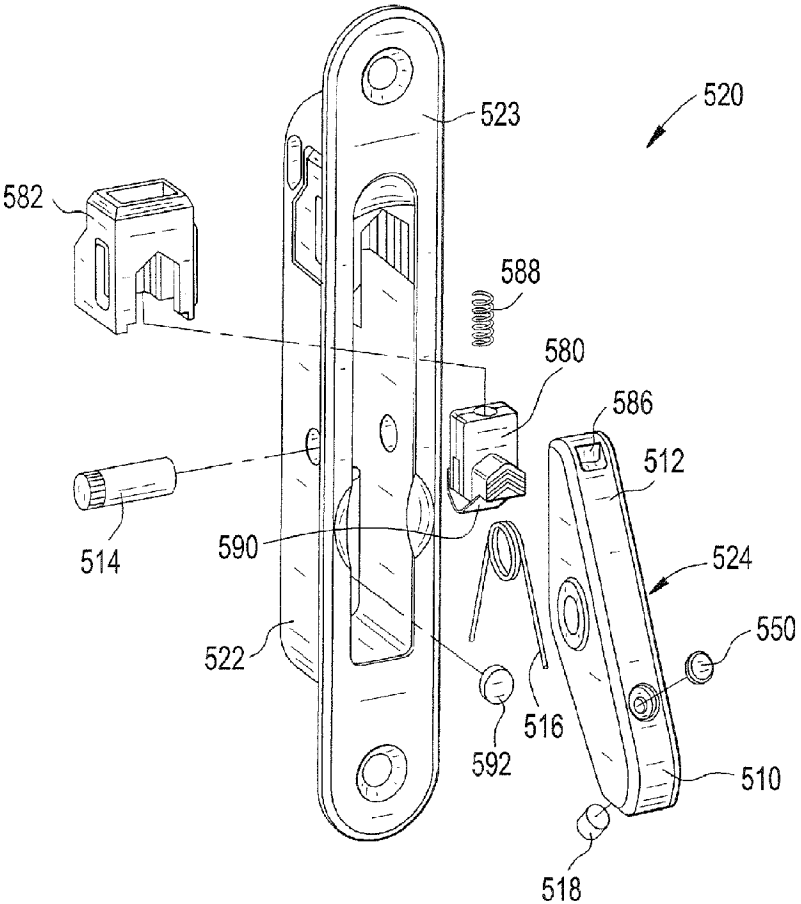
FIG. 33 is an exploded view of the sash window restrictor of FIG. 28.

A further embodiment shown in FIG. 34 is substantially the same as the embodiment shown in FIG. 33 but differs in the means for fixing the sash window restrictor to a frame. The sash window restrictor shown in FIG. 33 is front-mounted and fixed to a frame by means of the housing plate 523, in particular by screws that pass through holes in the mounting plate 523 and into the frame of the window. The embodiment shown in FIG. 34 does not include fixing means in the housing plate 623, and instead is fixed within a frame by screws or similar that pass through channels 694 in a rear part 696 of the housing 622.

Figures 35, 36, 37:
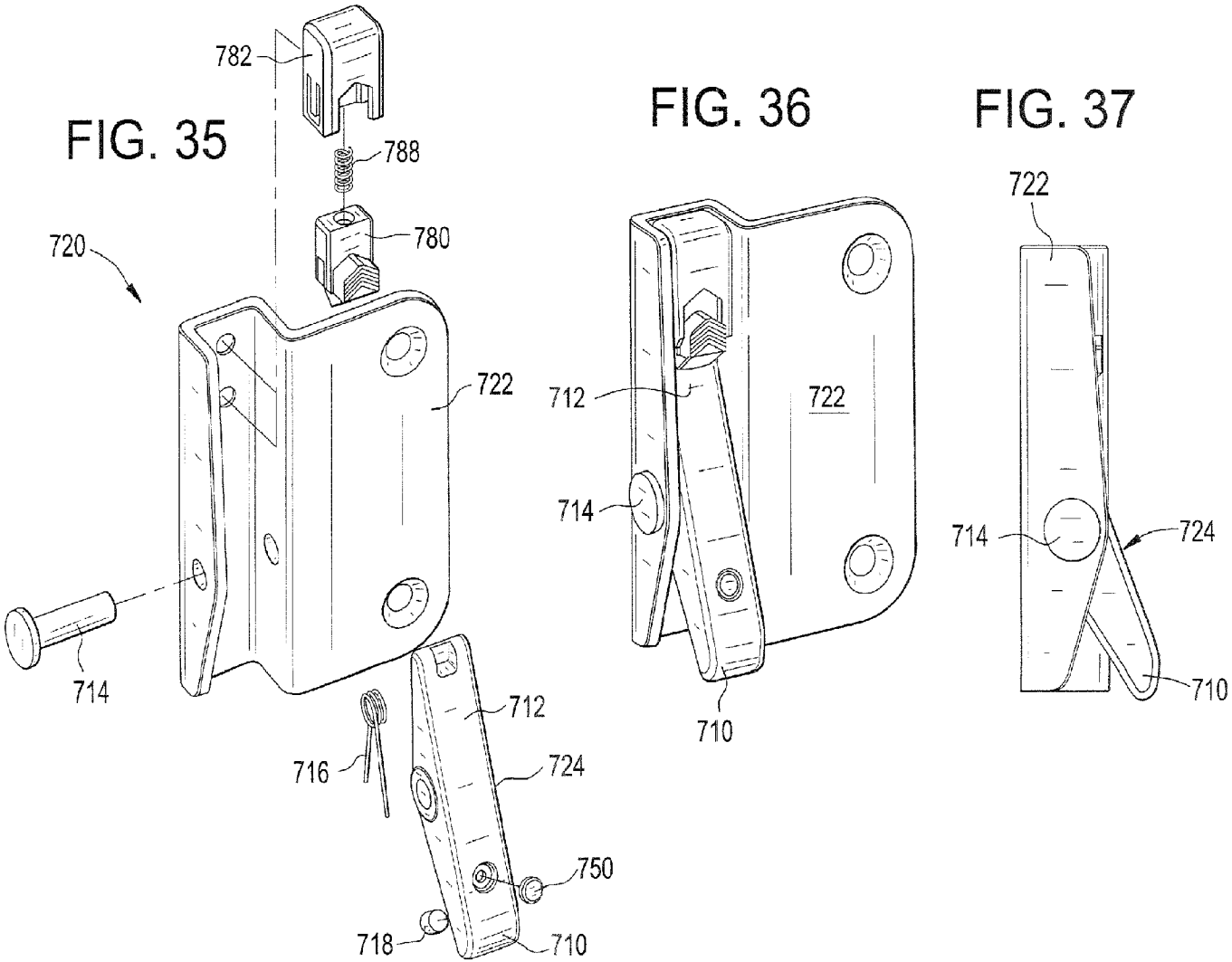
FIG. 35 is an exploded view of a sash window restrictor according to another embodiment of the invention.
FIG. 36 is a front perspective view of the sash window restrictor of FIG. 35.
FIG. 37 is a side view of the sash window restrictor of FIG. 35.
Figure 38:
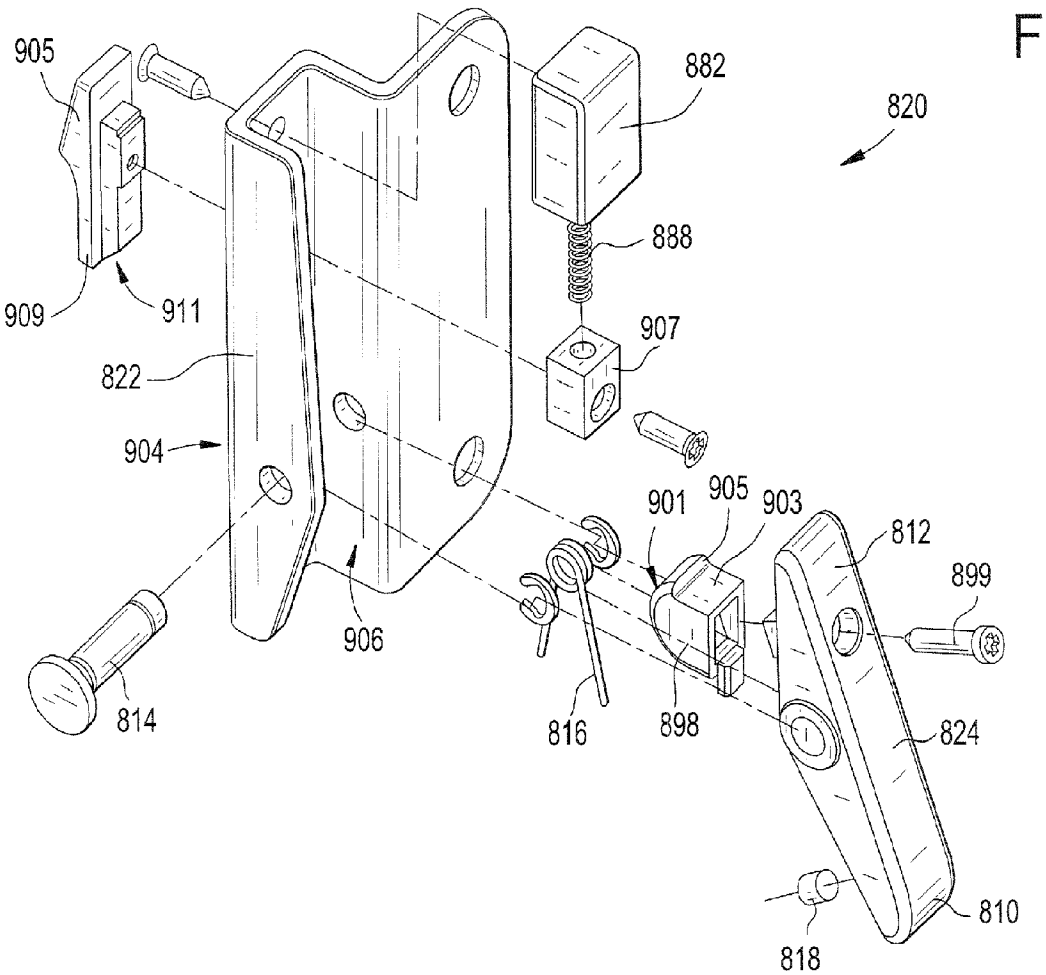
FIG. 38 is an exploded view of a sash window restrictor according to another embodiment of the invention.

FIGS. 35 to 37 illustrate an embodiment of a sash window restrictor 720 that is substantially similar to the embodiment shown in FIGS. 28 to 32, however, in this case, the housing 722 is such that the restrictor 720 may be fitted to the outside of a window frame. This has the advantage that the restrictor may be easily retro-fit as it does not require the restrictor to be mounted within the frame of the window.

Figure 42:
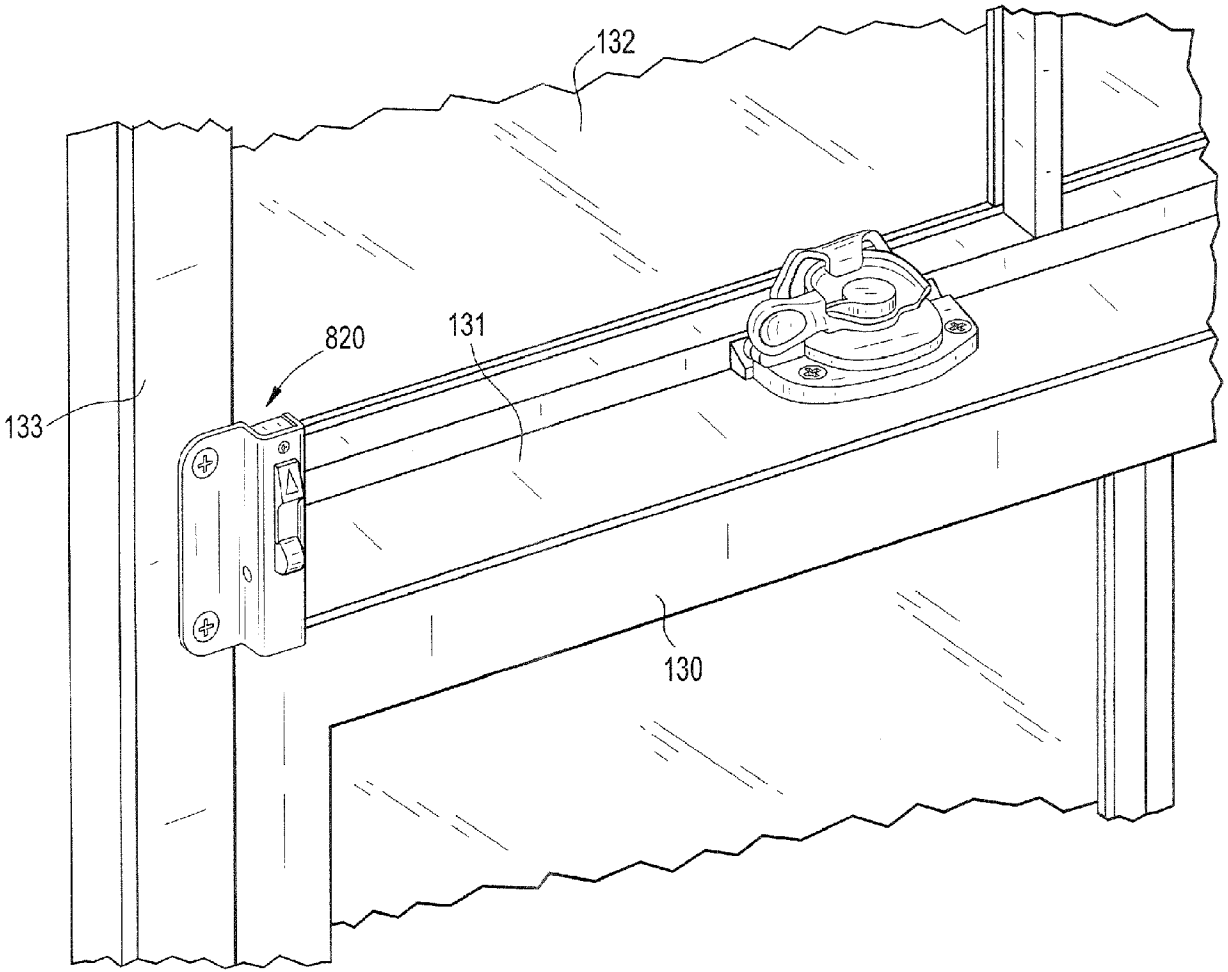
FIG. 42 shows the sash window restrictor of FIG. 38 mounted on a window frame.
Figure 43:
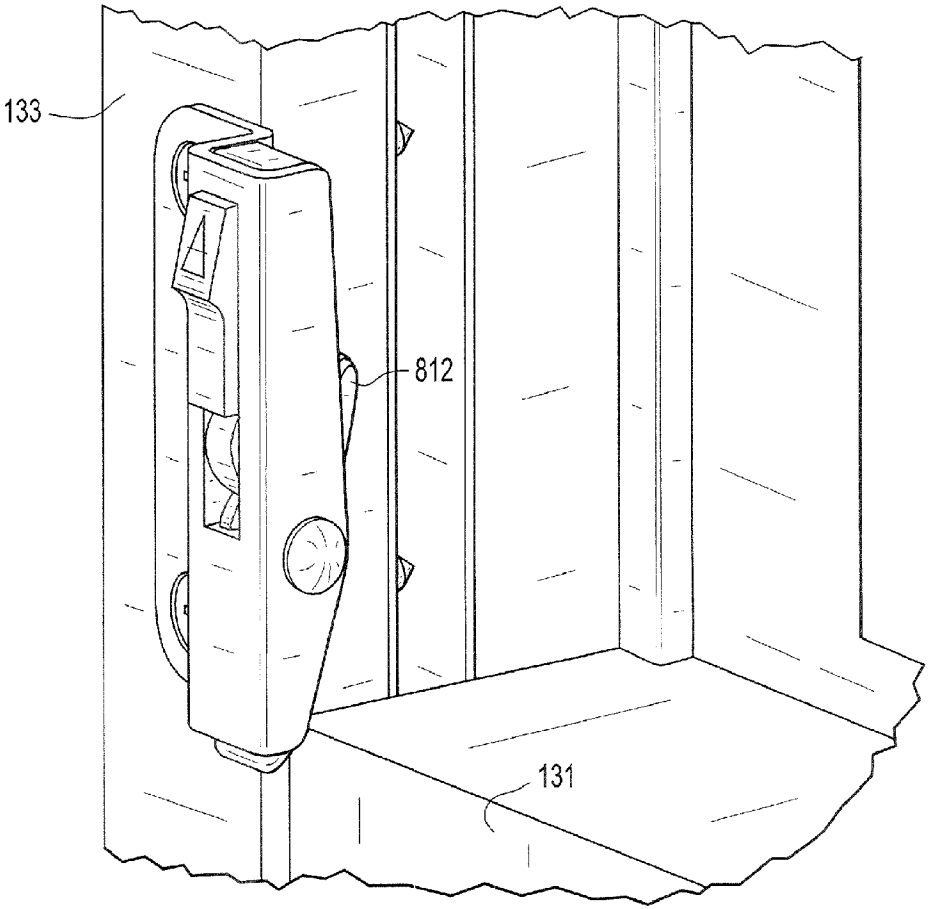
FIG. 43 shows the sash window restrictor of FIG. 42 with the tab retracted.
Figure 44:
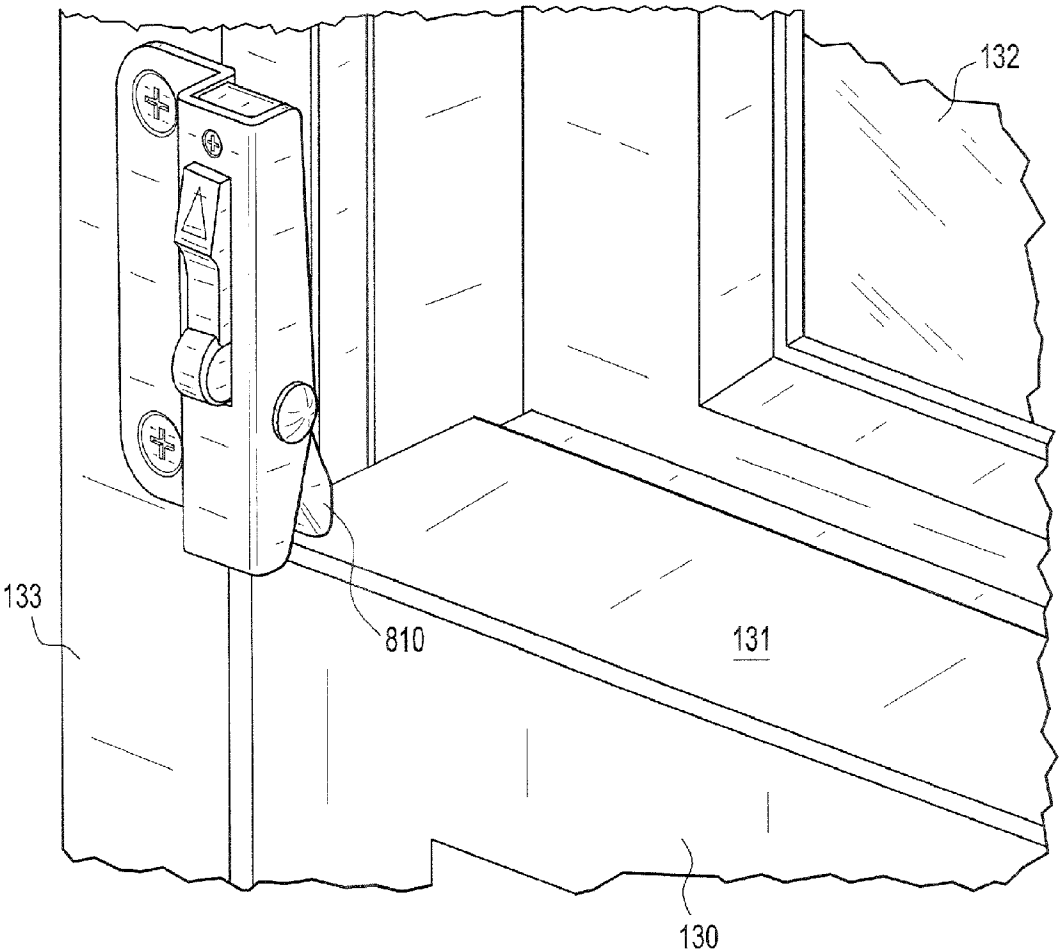
FIG. 44 shows the sash window restrictor of FIG. 42 with the tab extended.

A further embodiment of a sash window restrictor having a lock mechanism is shown in FIGS. 38 to 44. Similarly to the previous embodiment, the housing 822 is shaped so that the restrictor 820 may be fitted to an outer frame 133 of the window, with the first arm 810 of the tab 824 contacting an upper part 131 of a lower sash as illustrated in FIGS. 42 to 44.

In this embodiment, a button 898 is attached to the second arm 812. The button may be attached to the second arm 812 using any suitable means, but in this example it is fixed to the second arm 812 using a screw 899. The button 898 is substantially cuboid, with the face opposing the second arm being curved 901 in one direction. The end of the curved surface 901 stands proud of a top face 903 of the button 898 thereby forming a lip 905. The tab 824 is pivotally mounted in the housing 822 such that at least a part of the button 898 protrudes through the housing 822 and is visible from a front side 904 of the housing 822. In this arrangement, the arms 810, 812 of the tab 824 protrude from a rear side 906 of the housing 822.

In this embodiment, the slide member 880 comprises a slide plate 905 and a mounting block 907. The slide plate 905 and mounting block 907 are joined rigidly together such that a part of the slide plate 905 is on a front side 904 of the housing 822, and the mounting block 907 is on the rear side 906 of the housing 882. As described previously, a lock housing 882 is fixed into the housing 822, and the mounting block 907 slides within this lock housing 882. Biasing means, in this case a compression spring 888, is located between the mounting block 907 and a part of the lock housing 882. The compression spring 888 acts to bias the locking member 580 towards the tab 524, and in particular towards the second arm 512 and the button 898.

When the first arm 810 of the tab 824 is projecting out from the housing 822 of the sash window restrictor 820 to prevent a window sash being raised beyond a chosen height, an end 909 of the slide plate 905 abuts the top surface 903 of the button 898. Movement of the second arm 812 and button is prevented by the lip engaging with the slide plate, as shown in FIG. 40. The slide plate 905 is held in this position by the action of the compression spring 888. To allow the sash to be raised fully, the locking member 580, and in particular the slide plate 905 is first slid in a direction away from the button 898, in this example in an upwards direction such that the mounting block 907 slides into the lock housing 882. Once the end of the slide plate is disengaged from the lip of the button, the button can then be pressed through the housing. Pressing the button in this way causes the tab to rotate about the pivot member 814 so that the first arm 810 on the sash window restrictor 820 is retracted until it is held by magnetic contact, as described hereinbefore. Once a user has released the slide plate 905, the compression spring 888 urges the locking member 880 downwards so that the end of the slide plate extends partly in front of the button. In this position a chamfered edge 911 of the slide plate 905 rests against the curved surface 901 of the button 898.

When the sash is raised it acts to push the second arm 812 inwards and the first arm 810 is extended from the housing 822 by the action of the torsion spring 816. As this happens, the curved surface 901 of the button 898 slides against the chamfered edge 911 of the slide plate 905 and forces the locking member 880 upwards until the tab 824 has rotated sufficiently to cause the end 909 of the slide plate 905 to drop down behind the lip 905 and lock the tab 824 in position as described previously.

The sash window restrictor may be mounted to any suitable part of the window or window frame including a window frame member, a sash member, a stile, a jamb etc.

If required, the assembly may include a bracket or abutment member which is arranged on the other part of the window assembly from the tab and provides a suitable placed abutment surface to abut with the tab to restrict the opening of the window.

The present invention is for use with all suitable sash windows, for example horizontal and vertical sliding sash windows.

The invention claimed is:

1. A restrictor, comprising:

a housing;

a tab pivotally mounted on the housing;

a pushing element; and a restraining element, the tab comprising a first arm and a second arm, the tab being pivotally movable relative to the housing between:

at least a first pivot position, in which the restraining element is in a disengaged arrangement and at least a portion of the first arm is on a first side of a first plane and an entirety of the second arm is on a second side of the first plane, and a second pivot position, in which:

the restraining element is engaged, and the restraining element prevents the tab from pivoting, an entirety of the first arm is on the second side of the first plane, at least a portion of the second arm is on the first side of the first plane, and at least a portion of the second arm protrudes from the housing, the pushing element biasing the tab to pivot toward the first pivot position, with the restraining element engaged, the restraining element can be disengaged by pressing the second arm, such that the pushing element causes the tab to pivot toward the first pivot position.

2. A restrictor as recited in claim 1, wherein:

the tab is pivotally movable relative to the housing among at least the first pivot position, the second pivot position and a third pivot position in which the restraining element is in a disengaged arrangement, the tab is movable from the first pivot position to the second pivot position by applying force to the first arm and pushing the first arm to pivot the tab until the restraining element changes to an engaged arrangement, the tab is automatically moved from the second pivot position to the third pivot position by moving a substantially flat surface of a structure along the first plane and in contact with the second arm, and the tab is automatically moved from the third pivot position to the first pivot position by moving the substantially flat surface of a structure to a position where it is not in contact with the first arm.

3. A restrictor as recited in claim 1, wherein the restraining element can be changed from an engaged arrangement to a disengaged arrangement by applying a force to the second arm.

4. A restrictor as recited in claim 1, wherein the restraining element can be changed from a disengaged arrangement to an engaged arrangement by pivoting the tab.

5. A restrictor as recited in claim 1, wherein the restraining element can be changed from an engaged arrangement to a disengaged arrangement by moving a substantially flat surface of a structure along the first plane and in contact with the second arm.

6. A restrictor as recited in claim 1, wherein the housing comprises at least one surface that is substantially parallel to the first plane.

7. A restrictor as recited in claim 6, wherein a plurality of apertures are provided that extend through the at least one surface of the housing that is substantially parallel to the first plane, each of the apertures having an axis that is substantially perpendicular to the first plane.

8. A restrictor as recited in claim 1, wherein an entirety of the housing is on the second side of the first plane.

9. A restrictor as recited in claim 1, wherein an entirety of the restrictor, except for at least: a portion of the second arm, is on the second side of the first plane if the tab is in the second pivot position.

10. A restrictor as recited in claim 1, wherein the pushing element comprises a spring.

11. A restrictor as recited in claim 1, wherein the restraining element comprises a magnet.

12. A restrictor as recited in claim 11, wherein the magnet is located on the first arm.

13. A restrictor as recited in claim 1, wherein the restraining element comprises a snap.

14. A restrictor as recited in claim 1, wherein:

the housing comprises structure that defines a recess, and the first arm protrudes from the recess if the tab is in the first pivot position.

15. A restrictor, comprising:

a housing;

a tab pivotally mounted on the housing;

a pushing element; and a restraining element, the tab being pivotally movable relative to the housing between at least:

a first pivot position, and a second pivot position in which the restrictor is in an engaged arrangement, in which the pushing element biases the tab to pivot away from the second pivot position toward the first pivot position and the restraining element prevents the tab from being pivoted by the bias of the pushing element, and a third pivot position in which the restraining element is in a disengaged arrangement, in which the restraining element does not prevent the pushing element from pivoting the tab, contacting the tab with a substantially fiat surface of a structure by moving the substantially flat surface of the structure along a first plane defined by the substantially flat surface can cause the restraining element to be automatically changed from the engaged arrangement to the disengaged arrangement.

16. A restrictor as recited in claim 15, wherein:

the tab is movable from the first pivot position to the second pivot position by applying force to the tab and pushing the tab to pivot the tab until the restraining element changes to the engaged arrangement, and the tab is automatically moved from the third pivot position to the first pivot position by moving the substantially flat surface of a structure to a position where it is not in contact with the tab.

17. A restrictor as recited in claim 15, wherein the restraining element can be changed from the engaged arrangement to the disengaged arrangement by applying a pivoting force to the tab.

18. A restrictor as recited in claim 15, wherein the restraining element can be changed from the disengaged arrangement to the engaged arrangement by pivoting the tab.

19. A restrictor as recited in claim 15, wherein an entirety of the housing is on one side of the first plane.

20. A restrictor as recited in claim 15, wherein the pushing element comprises a spring.

21. A restrictor as recited in claim 15, wherein the restraining element comprises a magnet.

22. A restrictor as recited in claim 21, wherein the magnet is located on a first arm of the tab.

23. A restrictor as recited in claim 15, wherein the restraining element comprises a snap.

24. A restrictor as recited in claim 15, wherein the housing comprises at least one surface that is substantially parallel to the first plane.

25. A restrictor as recited in claim 24, wherein a plurality of apertures are provided that extend through the at least one surface of the housing that is substantially parallel to the first plane, each of the apertures having an axis that is substantially perpendicular to the first plane.

26. A sliding system, comprising:

at least a first member and a second member, at least the first member being movable relative to the second member between at least a first closed position and at least a first open position, and a restrictor, the first member having a first surface substantially aligned in a first plane, the second member having a second surface substantially aligned in a second plane, the second plane being substantially parallel to the first plane, the restrictor comprising a housing, a tab, a pushing element and a restraining element, the tab being pivotally movable relative to the housing between at least:

a first pivot position in which the tab prevents movement of the first member relative to the second member from the first closed position beyond a first relative position, and a second pivot position in which a portion of the tab is at least partially retracted into the housing from the first pivot position, the pushing element biases the tab to pivot away from the second pivot position toward the first pivot position and the restraining element is in an engaged arrangement in which the restraining element prevents the tab from being pivoted by the bias of the pushing element, movement of the first member from the first closed position, with the restraining element in the engaged arrangement, to the first open position resulting in the first member contacting the tab and causing the restraining element to automatically change to a disengaged arrangement in which the restraining element does not prevent the tab from pivoting by the bias of the pushing element.

27. A sliding system as recited in claim 26, wherein:

the tab comprises a first arm and a second arm, in the first pivot position, at least a portion of the first arm is on a first side of the first plane and an entirety of the second arm is on a second side of the first plane, and in the second pivot position, an entirety of the first arm is on the second side of the first plane, and at least a portion of the second arm is on the first side of the first plane.

28. A sliding system as recited in claim 26, wherein the first member at least partially overlaps the second member.

29. A sliding system as recited in claim 26, wherein the first member is a lower sash and the second member is an upper sash.

30. A sliding system as recited in claim 26, wherein movement of the first member from the first open position to the first closed position causes the tab to pivotally move to the first pivot position.

31. A sliding system as recited in claim 26, wherein:

the tab is movable from the first pivot position to the second pivot position by applying force to the tab and pushing the tab to pivot the tab until the restraining element changes to the engaged arrangement.

32. A sliding system as recited in claim 26, wherein the restraining element can be changed from the disengaged arrangement to the engaged arrangement by pivoting the tab.

33. A sliding system as recited in claim 26, wherein an entirety of the housing is on one side of the first plane.

34. A sliding system as recited in claim 26, wherein the housing comprises at least one surface that is substantially parallel to the first plane.

35. A sliding system as recited in claim 34, wherein a plurality of apertures are provided that extend through the at least one surface of the housing that is substantially parallel to the first plane, each of the apertures having an axis that is substantially perpendicular to the first plane.

36. A sliding system as recited in claim 26, wherein the pushing element comprises a spring.

37. A sliding system as recited in claim 26, wherein the restraining element comprises a magnet.

38. A sliding system as recited in claim 26, wherein the restraining element comprises a snap.

39. A restrictor, comprising:

a housing;

a tab;

a pushing element;

a restraining element; and means for selectively preventing movement of a first member that has a first surface substantially aligned in a first plane, relative to a second member that has a second surface substantially aligned in a second plane, the second plane being substantially parallel to the first plane, movement of the first member in a direction parallel to the first plane causes the first member to contact the tab to disengage the restraining element which, when engaged, prevents the pushing element from pivoting the tab.

40. A restrictor as recited in claim 39, wherein the housing comprises at least one surface that is substantially parallel to the first plane.

41. A restrictor as recited in claim 40, wherein a plurality of apertures are provided that extend through the at least one surface of the housing that is substantially parallel to the first plane, each of the apertures having an axis that is substantially perpendicular to the first plane.

42. A restrictor as recited in claim 39, wherein an entirety of the housing is on one side of the first plane.

43. A restrictor, comprising:

a housing;

a tab pivotally mounted on the housing, the tab pivotable among a first pivot position, a second pivot position and a third pivot position;

means for biasing the tab to pivot from the second pivot position toward the first pivot position; and means for selectively preventing the tab from pivoting from the second pivot position toward the first pivot position, the means for selectively preventing the tab from pivoting in a disengaged arrangement when the tab is in the first pivot position, the means for selectively preventing the tab from pivoting in an engaged arrangement which prevents the means for biasing the tab from causing the tab to pivot toward the first pivot position, when the tab is in the second pivot position, the means for selectively preventing the tab from pivoting in a disengaged arrangement when the tab is in the third pivot position, and with the means for selectively preventing the tab from pivoting in an engaged arrangement, pressing the tab can disengage the means for selectively preventing the tab from pivoting.

44. A restrictor as recited in claim 43, wherein:

the tab is movable from the first pivot position to the second pivot position by applying force to the tab and pushing the tab to pivot the tab until the means for selectively preventing the tab from pivoting changes to an engaged arrangement, and the tab is automatically moved from the third pivot position to the first pivot position by moving the substantially flat surface of a structure to a position where it is not in contact with the tab.

45. A restrictor as recited in claim 43, wherein the means for selectively preventing the tab from pivoting can be changed from an engaged arrangement to a disengaged arrangement by applying a pivoting force to the tab.

46. A restrictor as recited in claim 43, wherein the means for selectively preventing the tab from pivoting can be changed from a disengaged arrangement to an engaged arrangement by pivoting the tab.

47. A restrictor as recited in claim 43, wherein an entirety of the housing is on one side of the first plane.

48. A restrictor as recited in claim 43, wherein the housing comprises at least one surface that is substantially parallel to the first plane.

49. A restrictor as recited in claim 48, wherein a plurality of apertures are provided that extend through the at least one surface of the housing that is substantially parallel to the first plane, each of the apertures having an axis that is substantially perpendicular to the first plane.

50. A restrictor, comprising:

a housing;

a tab pivotally mounted on the housing; and a pushing element, the tab being pivotally movable relative to the housing between at least:

a first pivot position, and a second pivot position in which the pushing element biases the tab to pivot away from the second pivot position toward the first pivot position and the tab is prevented from being pivoted by the bias of the pushing element, and a third pivot position in which no portion of the restrictor prevents the pushing element from pivoting the tab toward the first position, contacting the tab with a substantially flat surface of a structure by moving the substantially flat surface of the structure along a first plane defined by the substantially flat surface can cause the tab to be automatically changed from the second pivot position to the third pivot position.

* * * * *

UNITED STATES PATENT AND TRADEMARK OFFICE

CERTIFICATE OF CORRECTION

PATENT NO. : 8,881,461 B2
APPLICATION NO. : 12/999751
DATED : November 11, 2014
INVENTOR(S) : Michael Derham It is certified that error appears in the above-identified patent and that said Letters Patent is hereby corrected as shown below:

In the Claims,

Column 13, Claim 9, line 28:

Please change "the restrictor, except for at least: a portion" to -- the restrictor, except for at least a portion --

Signed and Sealed this
Seventeenth Day of February, 2015

Michelle K. Lee

Michelle K. Lee
*Deputy Director of the United States Patent and Trademark Office*